US008684635B2

(12) United States Patent
Rainey

(10) Patent No.: US 8,684,635 B2
(45) Date of Patent: Apr. 1, 2014

(54) PRECAST WALL SYSTEM

(71) Applicant: Earth Reinforcement Technologies, LLC, Marietta, GA (US)

(72) Inventor: Thomas L. Rainey, Marietta, GA (US)

(73) Assignee: Earth Wall Products, LLC, Marietta, GA (US)

( * ) Notice: Subject to any disclaimer, the term of this patent is extended or adjusted under 35 U.S.C. 154(b) by 0 days.

(21) Appl. No.: 13/762,827

(22) Filed: Feb. 8, 2013

(65) Prior Publication Data

US 2013/0149033 A1 Jun. 13, 2013

Related U.S. Application Data

(60) Division of application No. 13/224,754, filed on Sep. 2, 2011, now Pat. No. 8,388,258, which is a continuation-in-part of application No. PCT/US2010/026373, filed on Mar. 5, 2010.

(60) Provisional application No. 61/157,958, filed on Mar. 6, 2009.

(51) Int. Cl.
*E04C 1/40* (2006.01)
*E04B 1/02* (2006.01)

(52) U.S. Cl.
USPC ..... 405/284; 405/302.7

(58) Field of Classification Search
USPC ..... 52/598, 599, 602–604, 608–612, 596; D25/113; 404/6, 18, 34; 405/262, 284, 405/302.7
See application file for complete search history.

(56) References Cited

U.S. PATENT DOCUMENTS

| | | | | |
|---|---|---|---|---|
| 5,257,880 | A | 11/1993 | Janopaul, Jr. | |
| 5,564,865 | A | 10/1996 | Jansson | |
| 6,536,994 | B2 * | 3/2003 | Race | 405/262 |
| 6,612,784 | B2 | 9/2003 | Rainey et al. | |
| 6,692,195 | B2 | 2/2004 | Jansson | |
| 6,761,509 | B2 | 7/2004 | Jansson | |
| 6,792,731 | B2 | 9/2004 | Bott et al. | |
| 7,073,984 | B2 | 7/2006 | Carey et al. | |
| 7,114,887 | B1 * | 10/2006 | Rainey | 405/262 |
| 7,124,544 | B2 | 10/2006 | Brown et al. | |
| 7,185,470 | B1 | 3/2007 | Link | |
| 7,390,146 | B2 * | 6/2008 | Rainey | 405/284 |
| 7,396,190 | B2 | 7/2008 | Price | |
| 7,445,407 | B2 * | 11/2008 | Rainey | 405/262 |
| 7,524,144 | B2 * | 4/2009 | Gravier et al. | 405/262 |
| 7,645,098 | B1 * | 1/2010 | Rainey | 405/284 |
| 7,828,498 | B2 * | 11/2010 | Sorheim et al. | 405/287 |
| 7,845,885 | B2 | 12/2010 | Jaeckln | |
| 8,388,258 | B2 | 3/2013 | Rainey | |
| 2002/0187010 | A1 * | 12/2002 | MacDonald et al. | 405/284 |
| 2003/0213203 | A1 * | 11/2003 | Bott et al. | 52/603 |
| 2004/0018061 | A1 * | 1/2004 | Jansson | 405/284 |

* cited by examiner

*Primary Examiner* — Gary Hartmann
(74) *Attorney, Agent, or Firm* — Thomas | Horstemeyer, LLC

(57) ABSTRACT

Disclosed herein are various embodiments of systems related to modular earth retaining wall systems. In one embodiment, among others, a precast retaining wall block configured for assembly into a retaining wall includes a front face portion, a web portion extending outwardly from a rear surface of the front face portion, a rear panel portion, and a geogrid material wrapped around the rear panel portion and extending outwardly from the rear panel portion. The web portion includes a vertical center portion and protrusions extending outwardly from the lower sides of the vertical center portion. The protrusions may be triangular.

17 Claims, 28 Drawing Sheets

STRAIGHT FACE

CONVEX FACE (OUTSIDE RADIUS)

CONCAVE FACE (INSIDE RADIUS)

PRECAST WALL SYSTEM

CROSS REFERENCE TO RELATED APPLICATIONS

This is a divisional of U.S. application Ser. No. 13/224,754, filed Sep. 2, 2011, which is a continuation-in-part (CIP) of PCT application no. PCT/US2010/026373, filed Mar. 5, 2010, which claims priority to U.S. provisional application Ser. No. 61/157,958, filed Mar. 6, 2009, both of the foregoing of which are incorporated herein by reference in their entirety.

BACKGROUND

Modular earth retaining walls are commonly used for architectural and site development applications. Such walls are subjected to very high pressures exerted by lateral movements of the soil, temperature and shrinkage effects, and seismic loads.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1A:
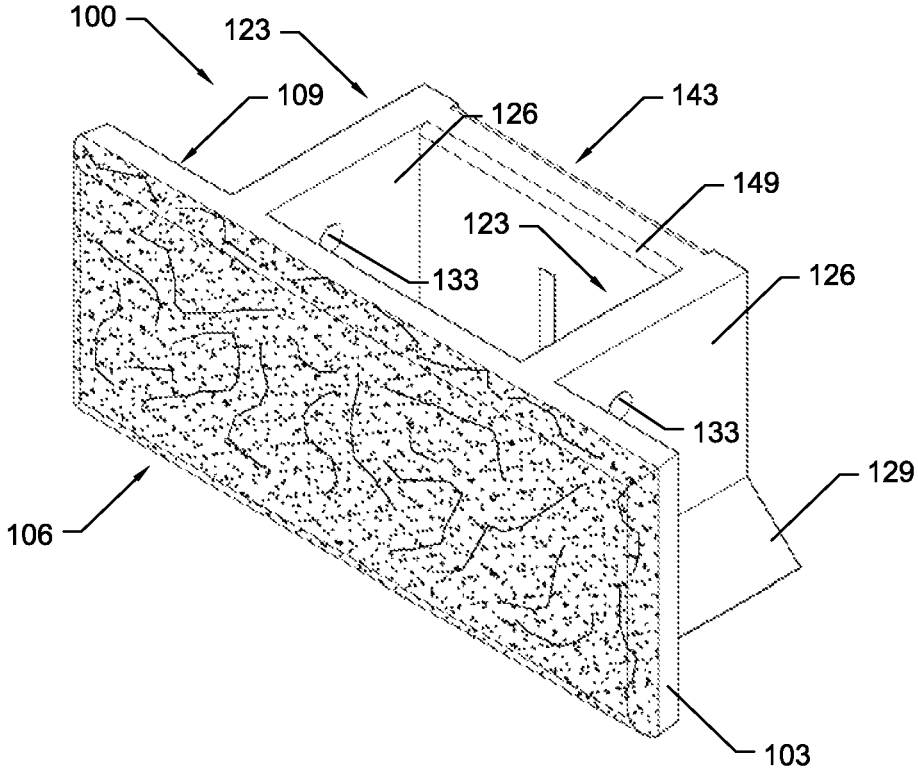
FIGS. 1A-1E are views of an exemplary precast wall system modular block in accordance various embodiments of the disclosure.

Disclosed herein are various embodiments of systems related to modular earth retaining wall systems. Reference will now be made in detail to the description of the embodiments as illustrated in the drawings, wherein like reference numbers indicate like parts throughout the several views.

Modular or segmental earth retaining walls commonly comprise courses or tiers of modular units or blocks. The blocks are typically made of concrete. The blocks are typically dry-stacked (i.e., no mortar or grout is used), and often include one or more features adapted to properly locate adjacent blocks and/or courses with respect to one another, and to provide resistance to shear forces from course to course. The weight of the blocks is typically in the range of fifty to several thousand pounds per unit. Modular retaining walls commonly are used for architectural and site development applications. Such walls are subjected to high loads exerted by the soil behind the walls. These loads are affected by, among other things, the character of the soil, the presence of water, surcharge loads, and seismic loads. To handle the loads, modular retaining wall systems often comprise one or more layers of soil reinforcement material extending behind the tiers of blocks back into the soil behind the blocks.

Figure 1B:
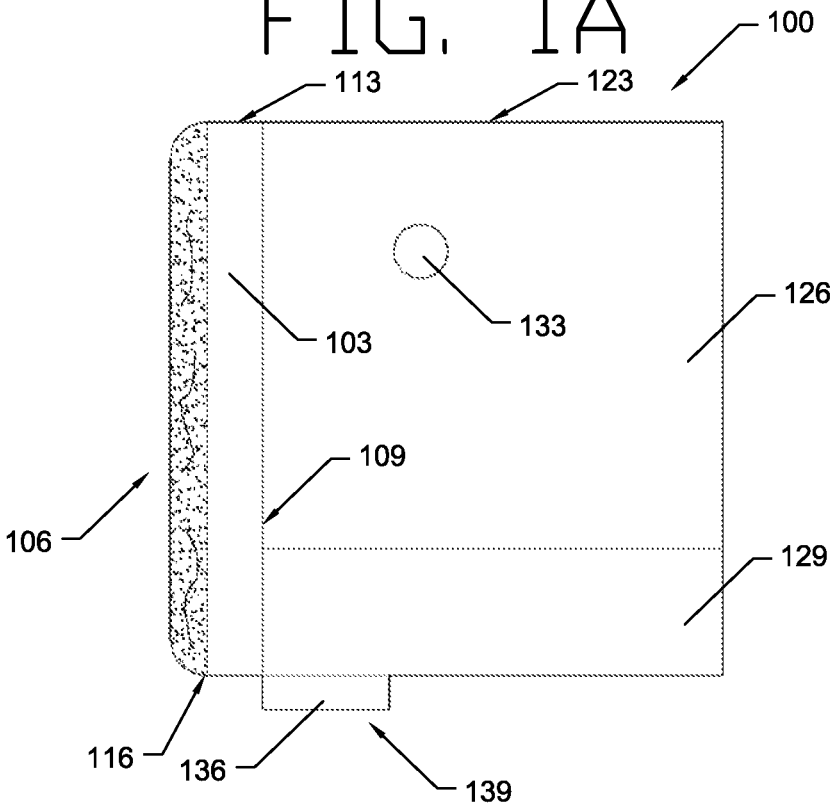
Figure 1C:
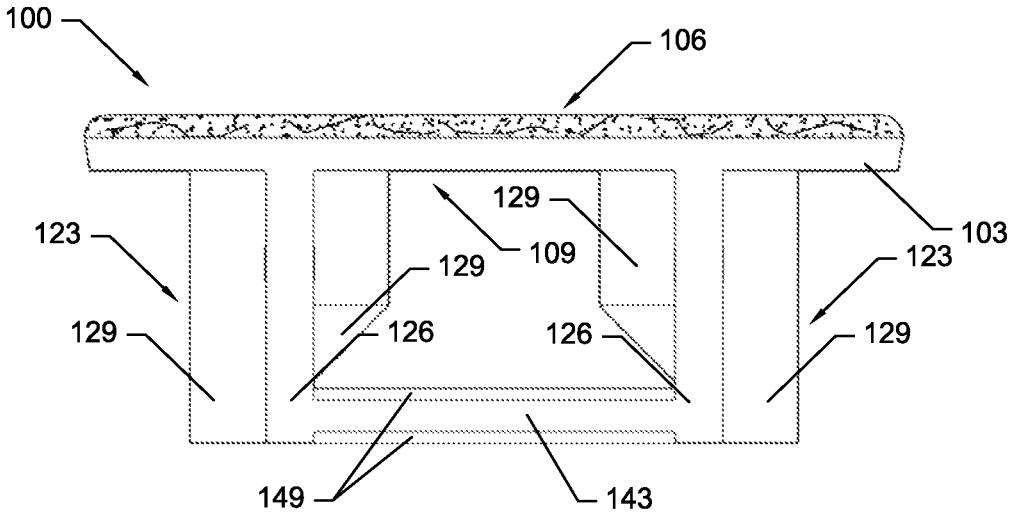
Figure 1D:
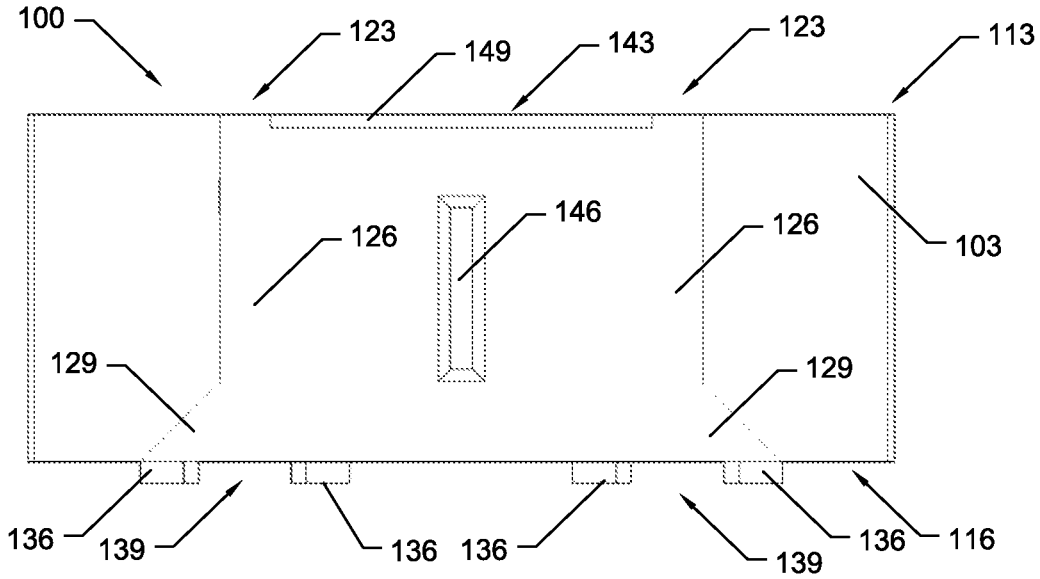
Figure 1E:
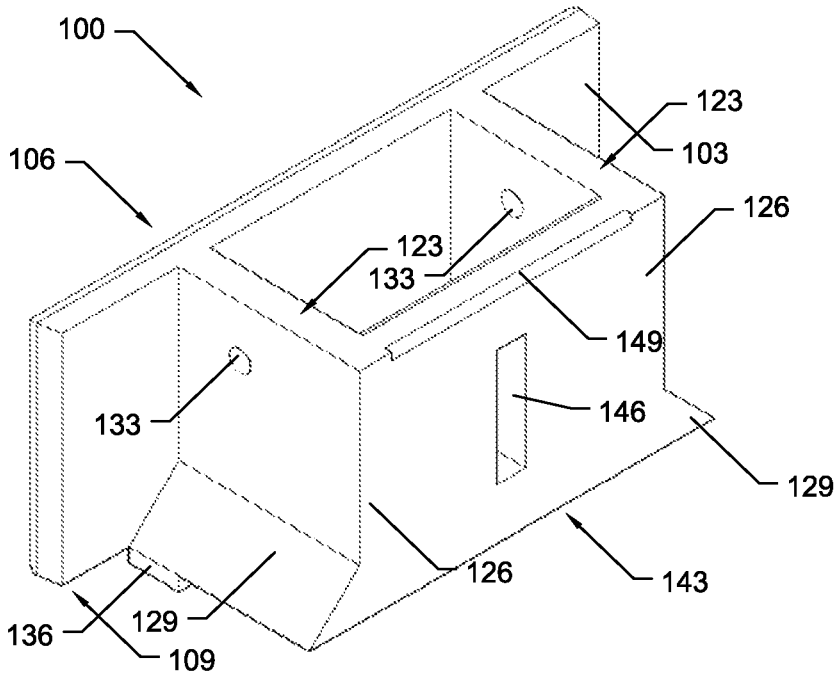
Figure 12A:
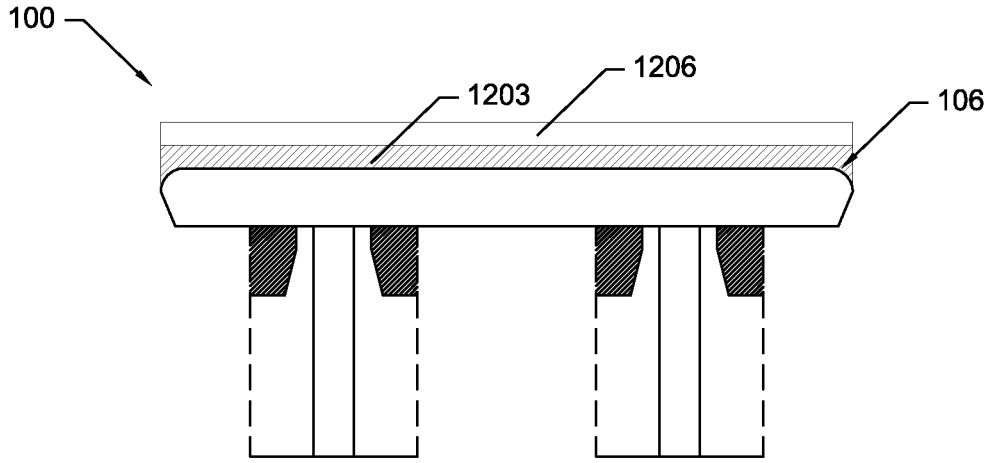
FIGS. 12A-12C illustrate precast wall system modular blocks including straight, convex and concave front face portions in accordance various embodiments of the disclosure.
Figure 12B:
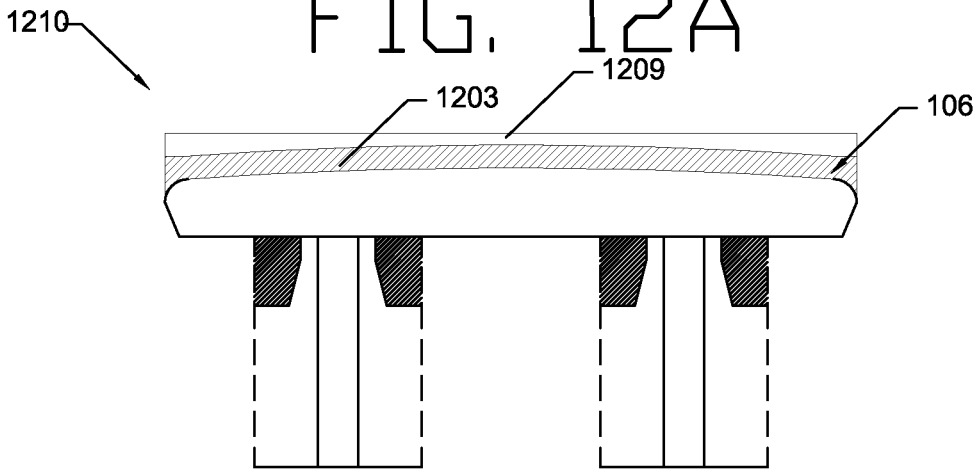
Figure 12C:
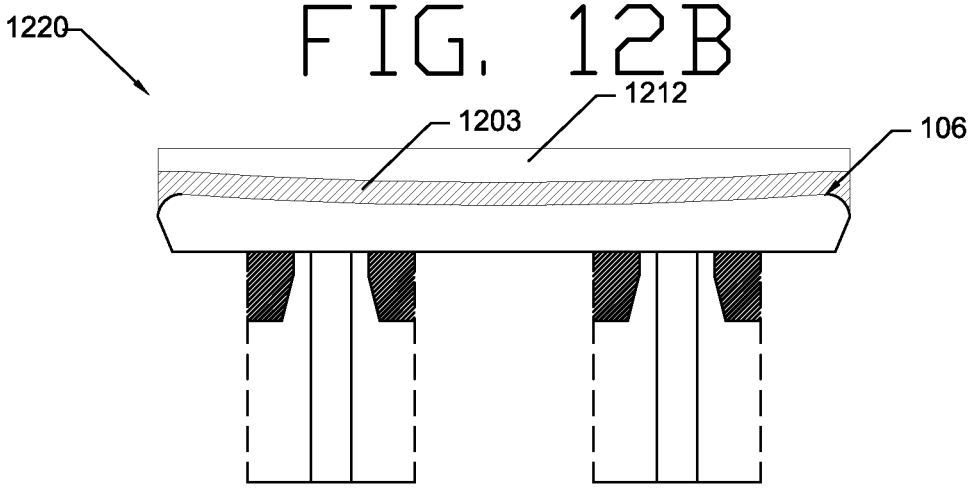

Generally speaking, the modular blocks can include blocks of different sizes, shapes, and orientations. With reference to FIGS. 1A-1E, shown is an exemplary embodiment of a modular block 100 including a horizontally oriented rectangular front face portion 103 including a front surface 106, a rear surface 109, a top surface 113, and a bottom surface 116. Other embodiments can include, but are not limited to, vertically oriented rectangular front face portions and/or front face portions of different dimensions. The front face portion 103 may include a front surface 106 that is sculptured or textured as illustrated in FIGS. 1A-1C. The front surface 106 may have a straight 100, convex 1210, or concave 1220 profile as illustrated in FIGS. 12A-12C, respectively. During fabrication, a filler 1206, 1209, 1212 is included in the mold to provide the desired shape. A mold liner 1203 is used to produce the desired texture of the front face portion 103.

In one embodiment, the front face portion 103 of modular block 100 has a height of about 18 inches, a width of about 48 inches, and a thickness of about 4 inches. Alternatively, the front face portion 103 of modular block 100 may have a height of about 30 inches, a width of about 75 inches, and a thickness of about 5 inches. Other embodiments may have front face portions 103 with other dimensional combinations (height×width) such as, but not limited to, about 18 inches by about 24 inches, about 18 inches by about 48 inches, about 36 inches by about 24 inches, and about 36 inches by about 90 inches. In addition, the thickness and front surface texture of the front face may vary between embodiments.

Figure 11A:
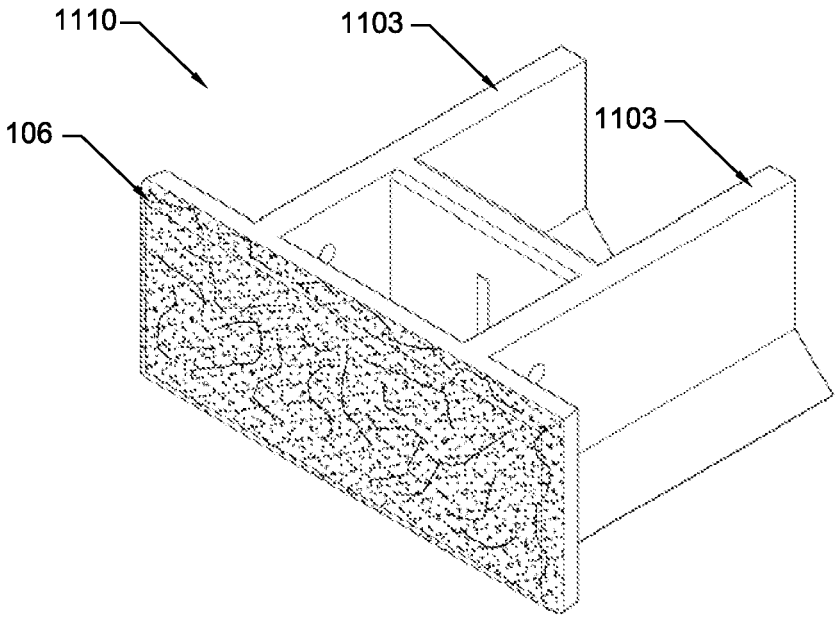
FIGS. 11A-11B are views of exemplary precast wall system modular blocks including extended web portions in accordance various embodiments of the disclosure.
Figure 11B:
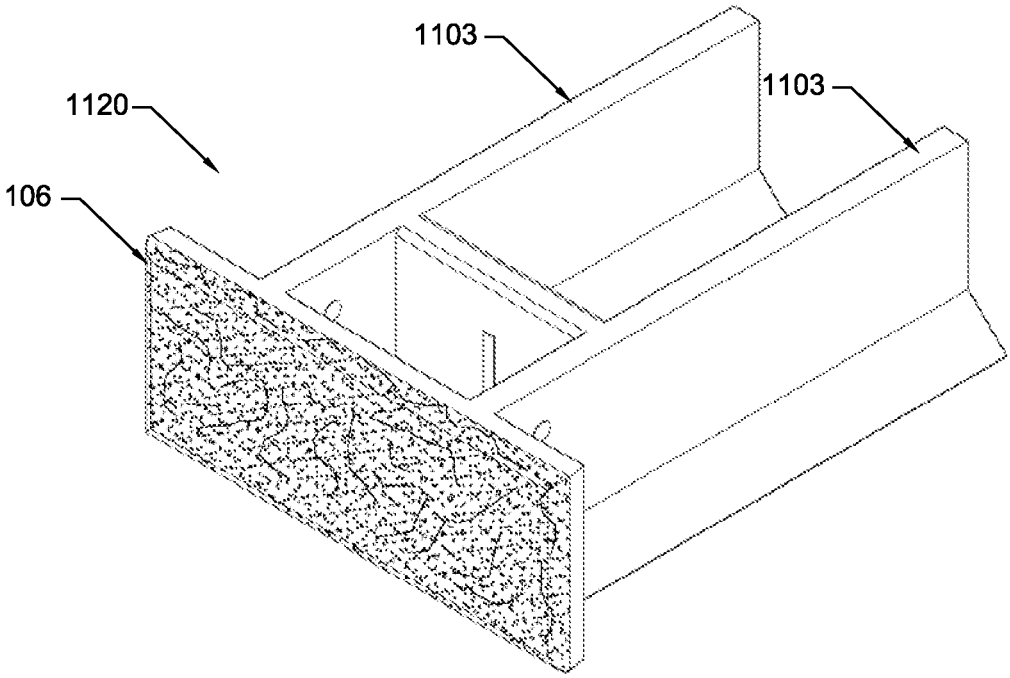

The modular block 100 also includes one or more web portions 123 extending from the rear surface 109 of the front face portion 103. In the embodiment of FIGS. 1A-1E, two web portions 123 extend from the rear surface 109 of the front face portion 103. In other embodiments, a single web portion 123 may extend from the rear surface 109 of the front face portion 103. In one embodiment, the web portion(s) 123 extends from (or beyond) the rear surface 109 a depth of about 14 inches. If the thickness of the front face portion 103 is about 4 inches, the overall depth of the exemplary modular block 100 is about 18 inches. In other embodiments (as illustrated in FIGS. 11A-11B), the extension depth of the web portion 123 can vary.

A web portion 123 includes a vertical center portion 126 that extends from the top surface 113 to the bottom surface 116 of the front face portion 103. Protrusions 129 extend from the lower sides of the vertical center portion 126. In the embodiment of FIGS. 1A-1E, the protrusions 129 are substantially triangular. The substantially triangular protrusions 129 may extend rearward along at least a portion of the web portion 123. In the embodiment of FIGS. 1A-1E, the substantially triangular protrusion 129 along the outer surface of the web portion 123 extends the entire length of the web portion 123 and the substantially triangular protrusion 129 along the inner surface of the web portion 123 extends along only a portion of the web portion 123. In the embodiment of FIGS. 1A-1E, the vertical center portion 126 has a thickness of about 3 inches and the substantially triangular protrusions 129 extend from the sides of the vertical center portion 126 about 5 inches. Alternatively, the vertical center portion 126 may have a thickness of about 3.5 inches and the substantially triangular protrusions 129 extend from the sides of the vertical center portion 126 about 5.5 inches.

Web portions 123 may also include one or more lifting and/or attachment holes 133, such as illustrated in the exemplary embodiment of FIGS. 1A-1E. The lifting holes 133 may be positioned in a centroid position to maintain the modular block in a level orientation when raised and during installation. This location of the lifting holes 133 also allows for pivoting of the block.

The modular block 100 may also include a rear panel portion 143 that extends between adjacent web portions 123. In the embodiment of FIGS. 1A-1E, the rear panel portion 143 extends from the top surface to the bottom surface of the web portions 123. In other embodiments, the height of the rear panel portion 143 may be less than the height of the web portions 123. The rear panel portion 143 may include a protrusion that extends toward the rear surface 109 of the front face portion 103 from an inner surface of the rear panel portion 143. The protrusion may be substantially triangular. The rear panel portion 143 may also include an opening 146 that extends through the rear panel portion 143. In the embodiment of FIGS. 1A-1E, the opening 146 is a vertical slot that is approximately centered in the rear panel portion 143.

Figure 2:
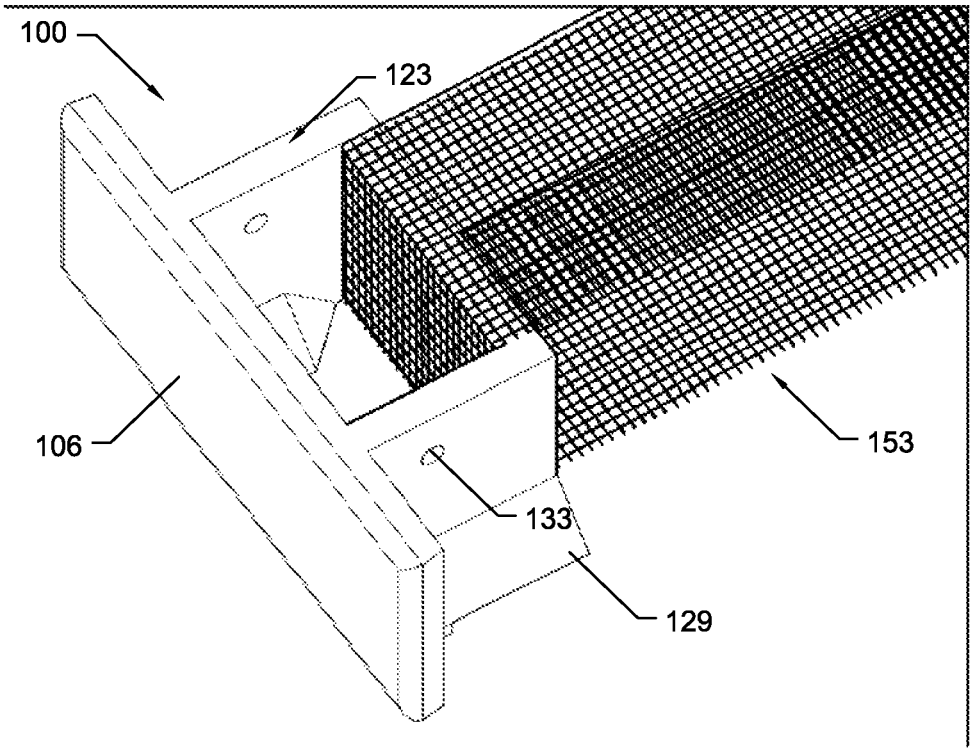
FIG. 2 is a view of the precast wall system modular block of FIGS. 1A-1E including an exemplary mechanical geogrid connection in accordance various embodiments of the disclosure.
Figure 14:
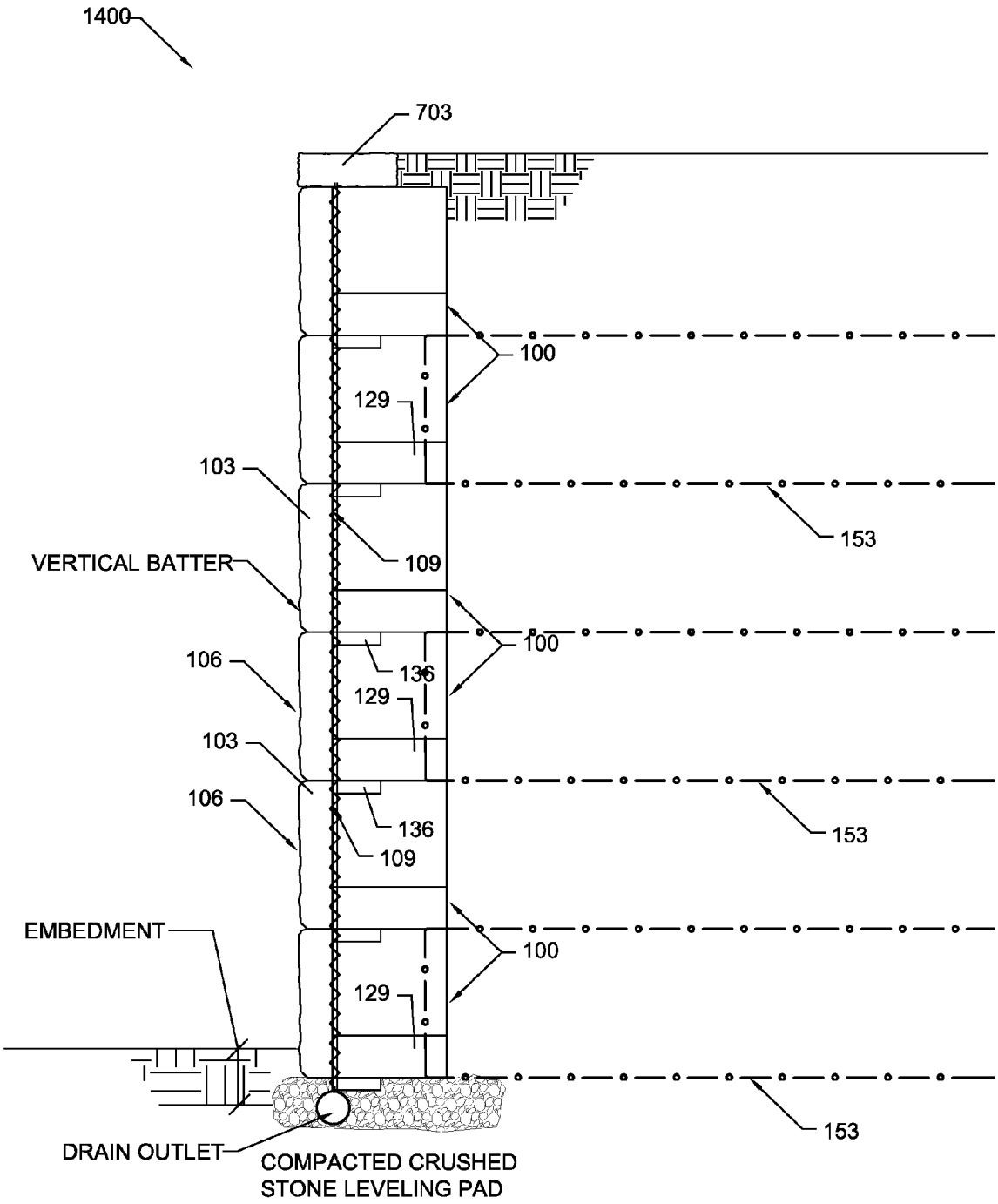
FIG. 14 is a cross-sectional view an exemplary precast wall system including the mechanical geogrid connection of FIG. 2 in accordance various embodiments of the disclosure.

FIG. 2 provides a view of the precast wall system modular block 100 of FIGS. 1A-1E including an exemplary mechanical geogrid connection. A polymer geogrid 153 wrapped around the rear panel portion 143 may extend longitudinally into backfill soil to provide additional support to a wall system including the modular block 100. In another embodiment, an anchor bar 906 (FIG. 9) may be attached through the vertical slot 146 of the rear panel portion 143 to provide additional support to the wall system. The corners 149 at the top and/or bottom of the rear panel portion 143 may be curved, rounded, or tapered (as illustrated in FIGS. 1A-1E) to reduce wear of the material of the geogrid 153 when installed. FIG. 14 is a cross-sectional view illustrating a precast wall system 1400 including the geogrid 153 extending into the earth behind the wall system 1400. As depicted, the geogrid 153 wraps around the rear panel portion 143 and extends rearward from both the top and bottom of the rear panel portion 143. As shown in FIG. 14, the construction of the retaining wall system 1400 can be summarized as follows: a plurality of stacked rows of precast retaining wall blocks 100, each of the wall blocks 100 comprising a front surface, a top surface, a bottom surface, and an opening defined by internal walls between the top and bottom surfaces; and a geogrid material 153 having a planar elongated body with first and second parts embedded in soil and a third part connecting the first and second parts and extending through the opening of at least one of the wall blocks 100.

Figure 3A:
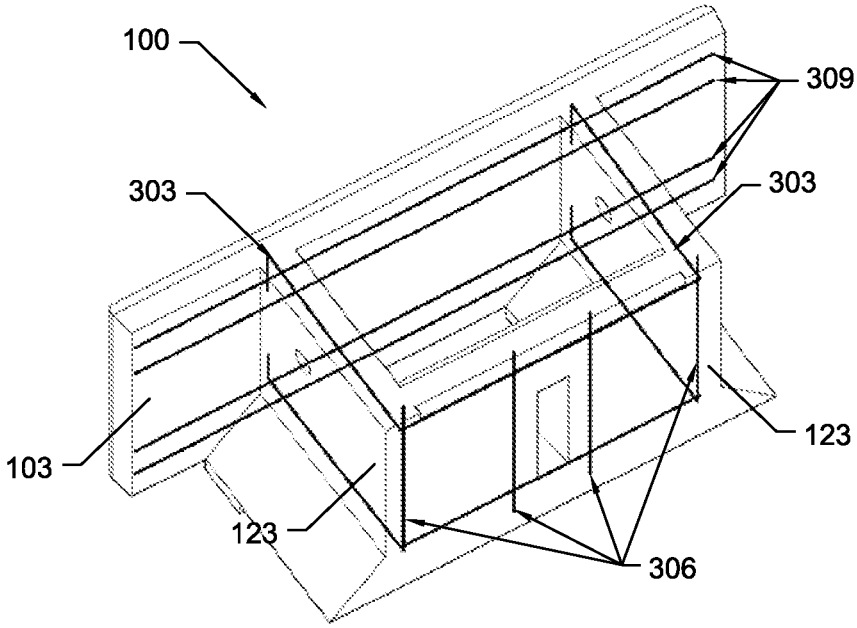
FIGS. 3A-3B are views of an exemplary system of reinforcement of a precast wall system modular block of FIGS. 1A-1E in accordance various embodiments of the disclosure.
Figure 3B:
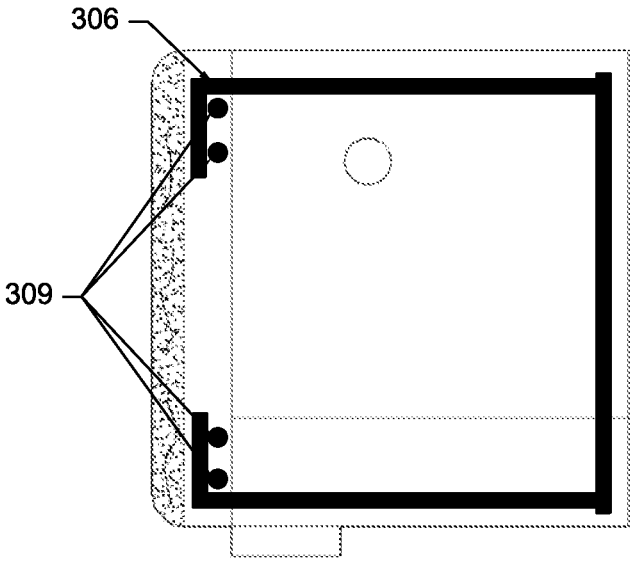

With reference to FIGS. 3A-3B, shown is an exemplary system of reinforcement that can be included in a modular block 100. In the embodiment of FIGS. 3A-3B, the modular block 100 is reinforced with reinforcing rods (or rebar). A plurality of rebar rods 309 (e.g., two or four) are positioned horizontally within the front face portion 103 (e.g., at the top and bottom) as illustrated in FIG. 3A. Additional rebar rods 303 extend through each of the web portions 123 such that the rebar rods 306 hook around at least one of the horizontal rebar rods 309 within the front face portion 103 and extend vertically within the front face portion 103 as illustrated in FIG. 3B. In some embodiments, the rebar rods 303 in the web portions 123 are formed in a C-shape, which extends from the rear of the web portions 123 into the front face portion 103, with the opening of the C-shape within the front face portion 103. In the embodiment of FIGS. 3A-3B, rebar rods extend horizontally through the rear panel portion 143 into the web portions 123. The horizontal rebar rods in the rear panel portion 143 may be extensions of bars 303 or may be separate rebar rods. Vertical rebar rods 306 may be included in the ends of the web portions 123 and/or adjacent to the vertical slot 146 in the rear panel portion 143 to provide additional reinforcing at stress points. In other embodiments, additional rebar rods and/or shapes may be utilized.

Figure 4A:
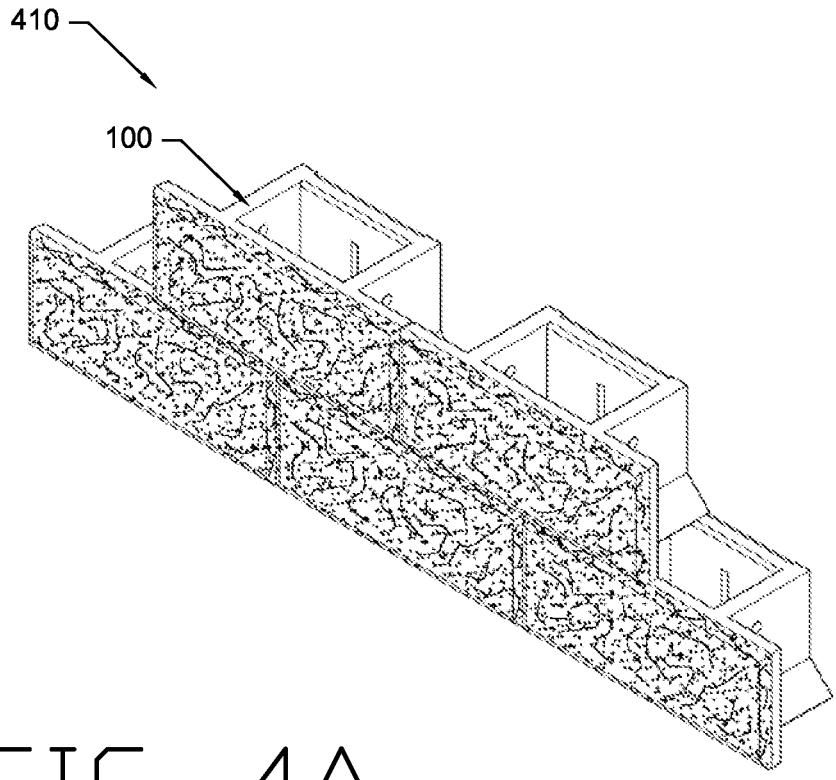
FIGS. 4A-4B are views of an exemplary precast wall systems including the precast wall system modular block of FIGS. 1A-1E in accordance various embodiments of the disclosure.
Figure 4B:
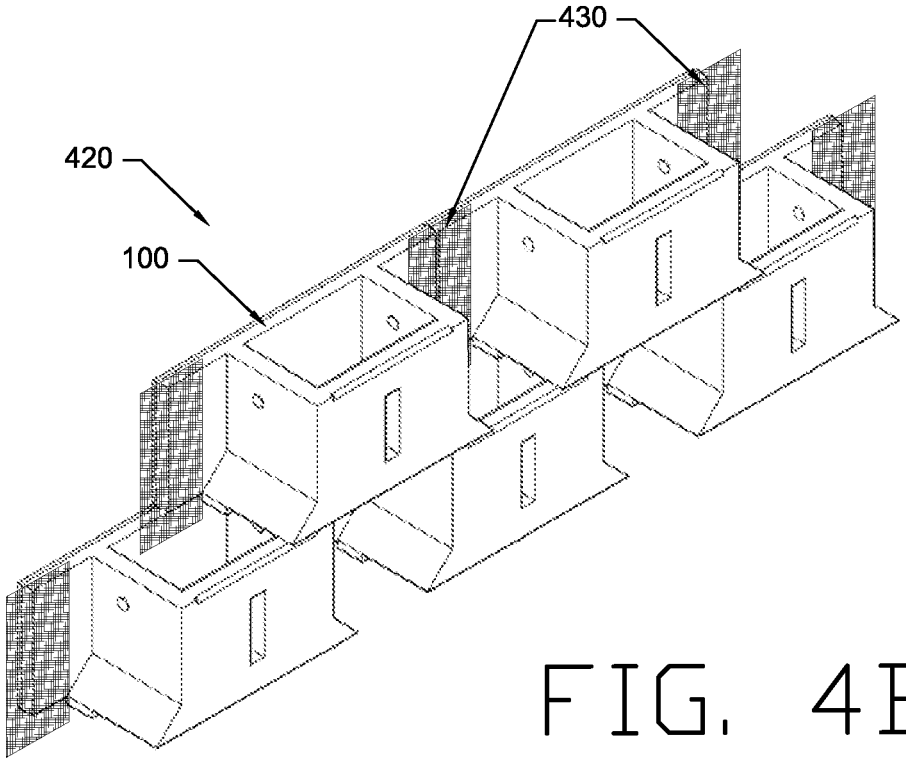
Figure 5:
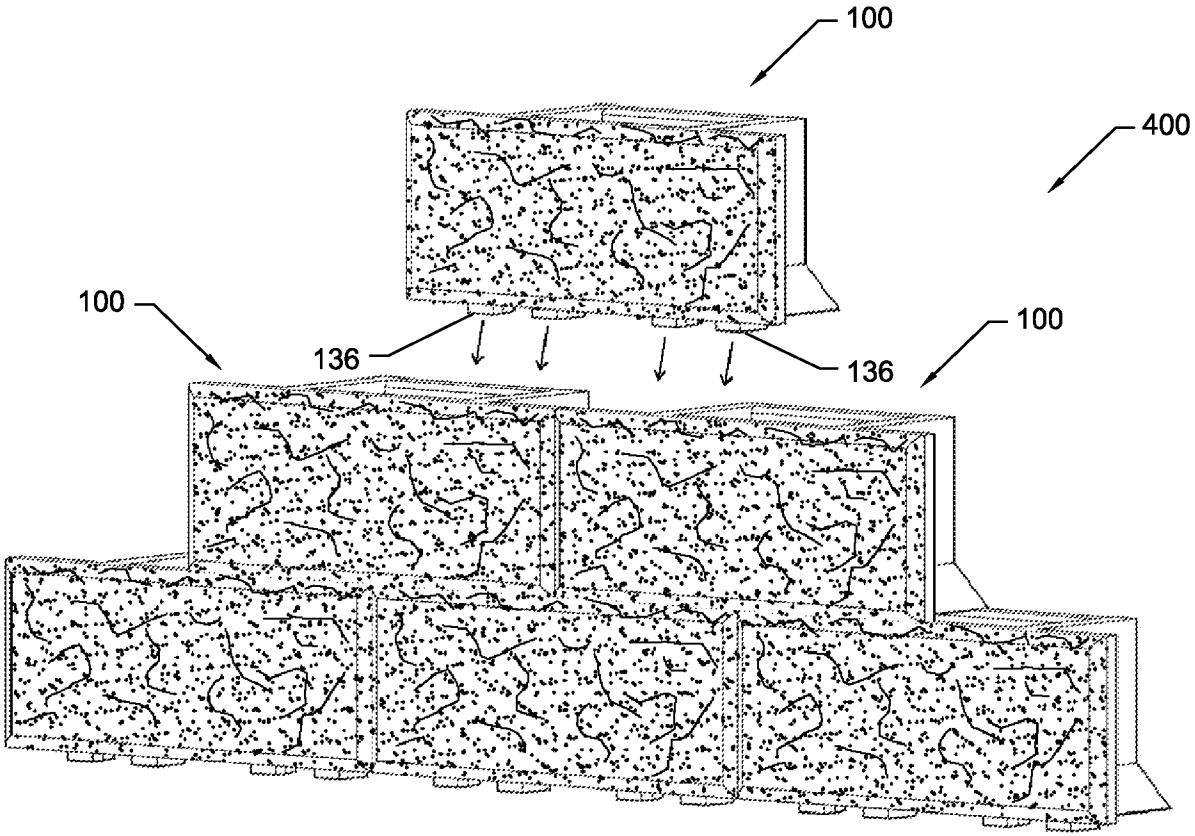
FIG. 5 illustrates the addition of a modular block of FIGS. 1A-1E to an exemplary precast wall system in accordance various embodiments of the disclosure.

With reference to FIGS. 4A-4B, shown are exemplary precast wall systems 410 and 420 in accordance various embodiments of the disclosure. The precast wall systems include a plurality of courses of modular blocks 100. In some embodiments, the precast wall systems may include blocks of different sizes, shapes, and orientations. Each modular block 100 may be configured so as to mate with at least one other modular block 100 when the blocks are stacked atop one another to form a modular retaining wall 400 as illustrated in FIG. 5. This mating restricts relative movement between vertically adjacent modular blocks 100 in at least one horizontal direction and allows adjacent courses of blocks 100 to be aligned with one another. To provide for this mating, the modular blocks 100 can include locking means that secure the blocks 100 together to further increase wall stability.

Referring back to the exemplary embodiment of FIGS. 1A-1E, the locking means may be provided on one or more web portions 109 by aligning elements 136 such as, but not limited to, tabs or nodes that extend from the bottom of the protrusions 129. The aligning elements 136 of FIGS. 1A-1E extend along the bottom of the protrusions 129 from the rear surface 109 of the front face portion 103 towards the rear of the web portion 123 to form an alignment seat 139. The aligning elements 136 may extend rearward along a portion of the substantially triangular protrusion 129 or along the entire length of the substantially triangular protrusion 129. When stacked atop one or more blocks 100, the alignment seat 139 is positioned atop the vertical center portion 126 of a web portion 123 of a block in the lower course. The front of the aligning elements 136 is aligned with the rear surface 109 of the front face portion 103 to allow the modular blocks 100 to be properly located with modular blocks 100 in the lower course and to provide resistance to shear forces from course to course. An aligning element 136 extends along each side of the vertical center portion 126 to align the block 100 and limit lateral movement of the block 100. In one embodiment, the aligning elements 136 are tabs having a height of about 1.5 inches and a depth of about 6 inches. Alternatively, the height may be about 2 inches. Various tab widths and depths can be provided to allow alignment with the top of a web portion 123 in the lower course. The modular blocks 100 in the bottom course may not include alignment seats 139 (e.g., formed by aligning elements 136) to facilitate leveling.

Figure 6A:
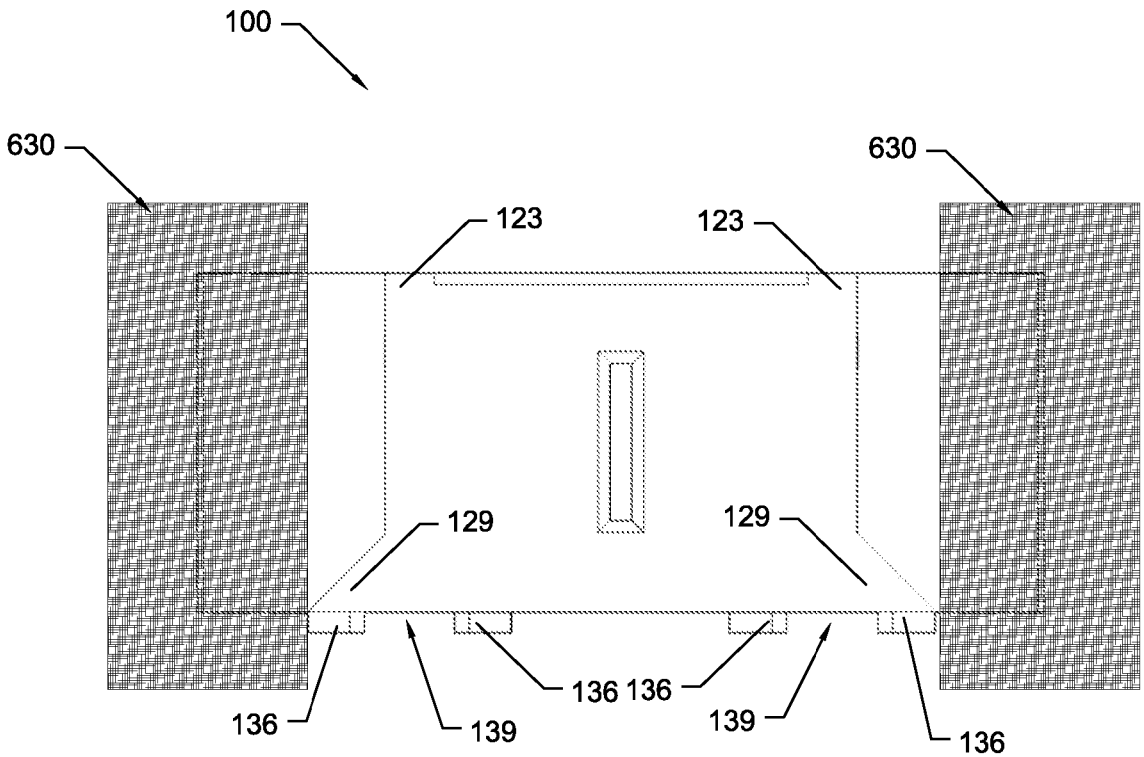
FIG. 6A-6B are views of a drainage material installed on a precast wall system modular block of FIGS. 4A-4B and 5 in accordance various embodiments of the disclosure.
Figure 6B:
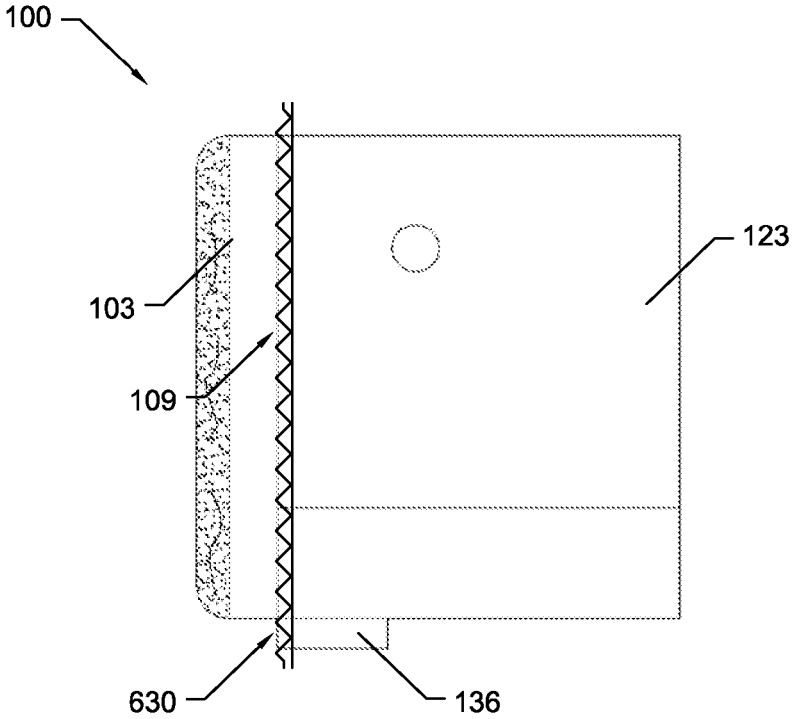

As illustrated in FIGS. 4B and 6A-6B, drainage materials 430 and 630 may be secured to roll down the rear surface 109 of the front face portion 103 between the web portions 123. Drainage materials 430/630 include, but are not limited to, filter fabric and prefabricated plastic drainage board.

Figure 7:
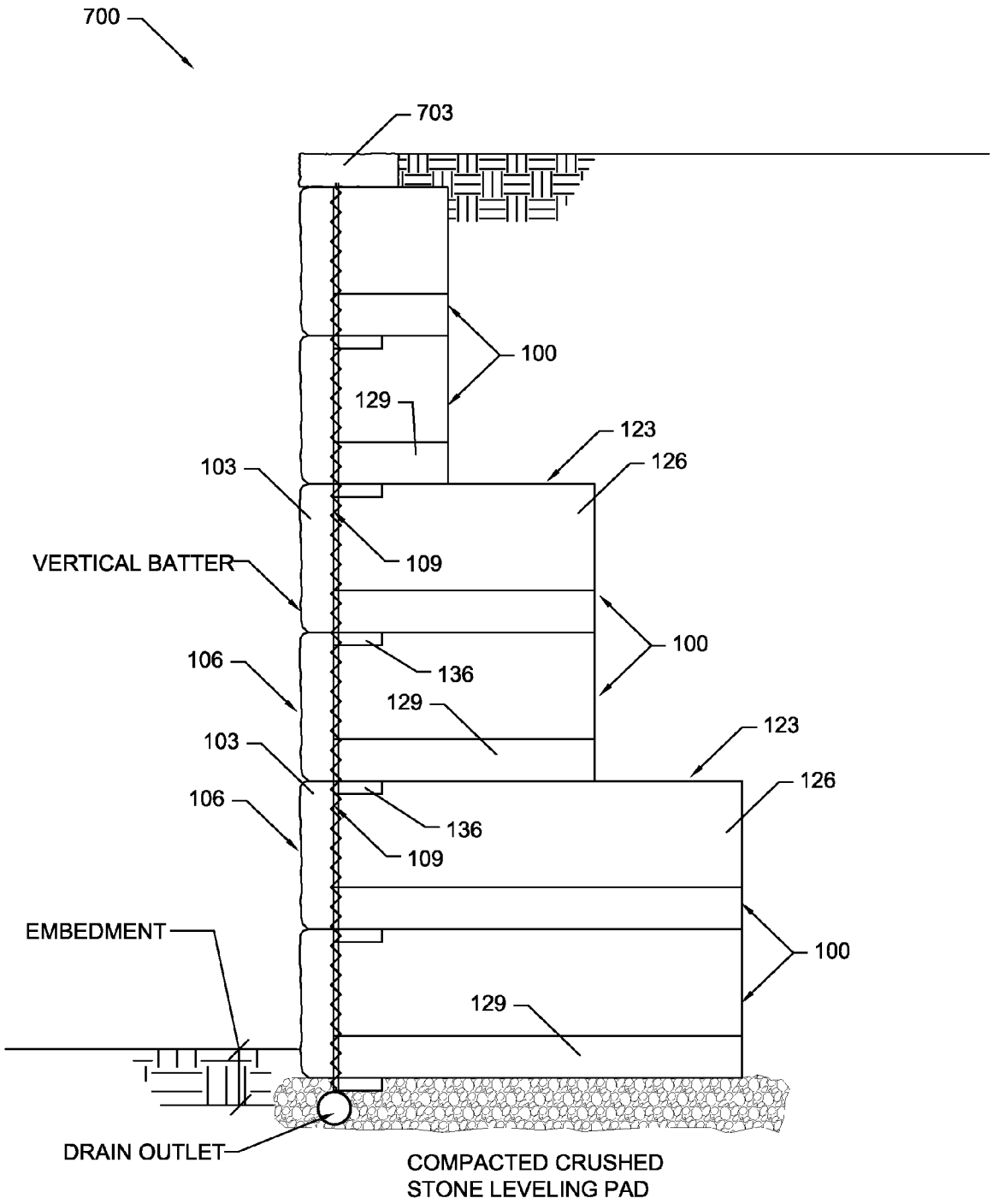
FIG. 7 is a cross-sectional view an exemplary precast wall system including a cap unit in accordance various embodiments of the disclosure.

FIG. 7 illustrates an exemplary precast wall system 700 including six courses of blocks 100. In the embodiment of FIG. 7, the depth of the web portions 123 is increased for the lower courses for overall structure stability and to resist soil and surcharge loads. The additional depth, when combined with the triangular protrusions 123, provides added stabilization and support for the wall system. Other groupings may be utilized in other embodiments (e.g., different web depths for each course or groups of three as in FIG. 10).

Figure 8:
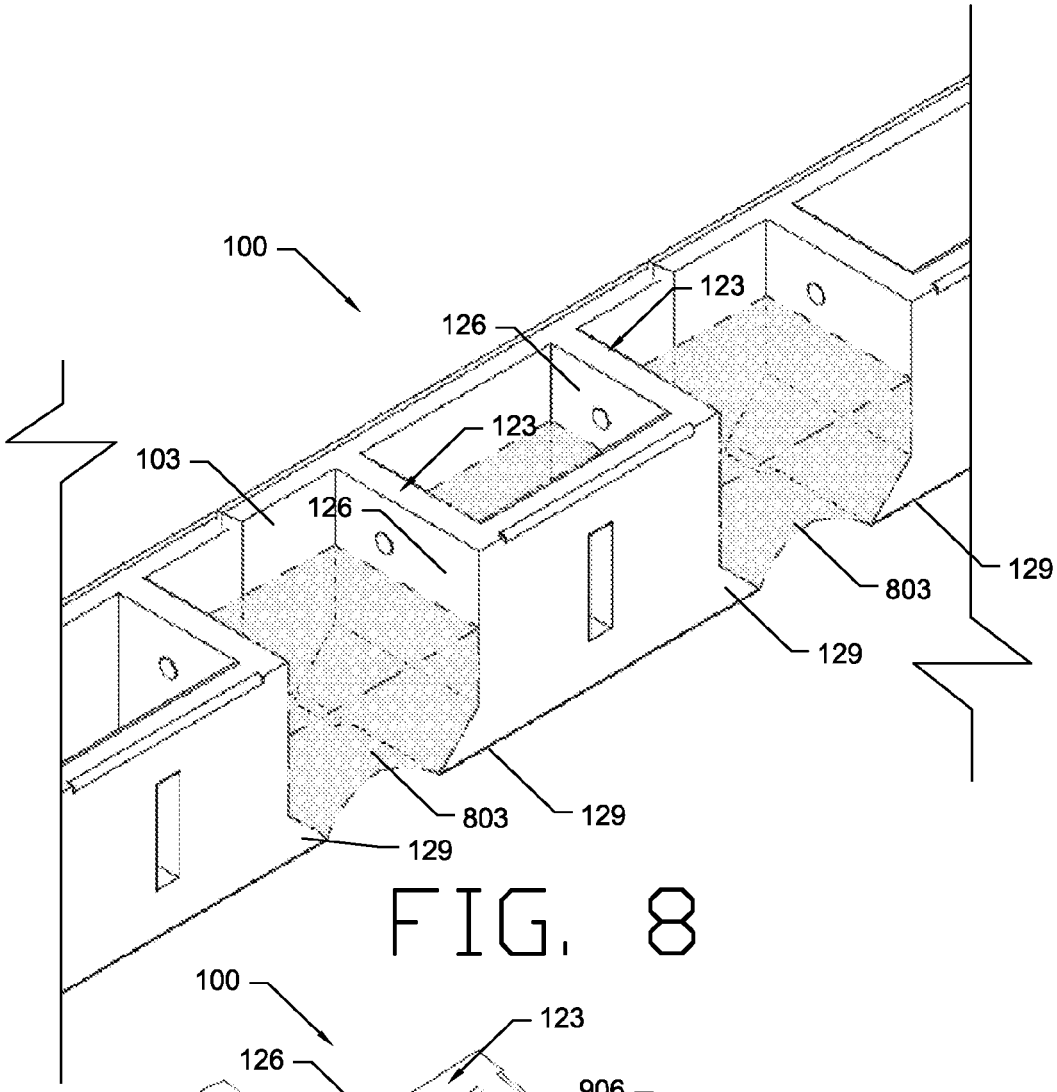
FIG. 8 illustrates the addition of backfill to a modular block of FIGS. 1A-1E to an exemplary precast wall system in accordance various embodiments of the disclosure.

The web portions 123 of each course extend back into the earth to create a gravity system to resist overturning and sliding of the precast wall system. Stone and/or soil 803 can be deposited between the web portions to provide additional downward force on the web portions 123 of the modular block 100 to resist overturning or sliding. Referring now to the modular block 100 of FIG. 8, the substantially triangular protrusions 129 are obliged at opposing sides of the vertical center portion 126 to create an arch of the stone and/or soil 803 placed between the web portions 123, which creates a downward force on the web portions 123 of the modular block 100 to resist movement of the block 100 from its stationary position, therein creating a stable mass to resist overturning and sliding. In some embodiments, the web portions 123 may be extended beyond the rear panel portion 143, as illustrated in FIGS. 11A-11B, to provide additional stability to the wall system. For example, the web portions 1103 extending rearward beyond the rear panel portion 143 of modular block 1110 of FIG. 11A may extend to a depth of about 60 inches while the web portions 1103 extending rearward beyond the rear panel portion 143 of modular block 1120 of FIG. 11B may extend to a depth of about 96 inches.

Figure 9:
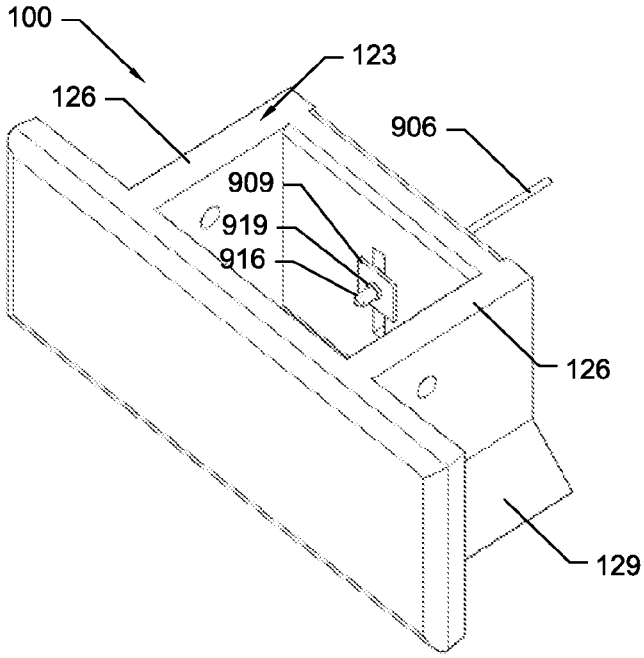
FIG. 9 is a view of the precast wall system modular block of FIGS. 1A-1E including an exemplary soil nail connection in accordance various embodiments of the disclosure.
Figure 13:
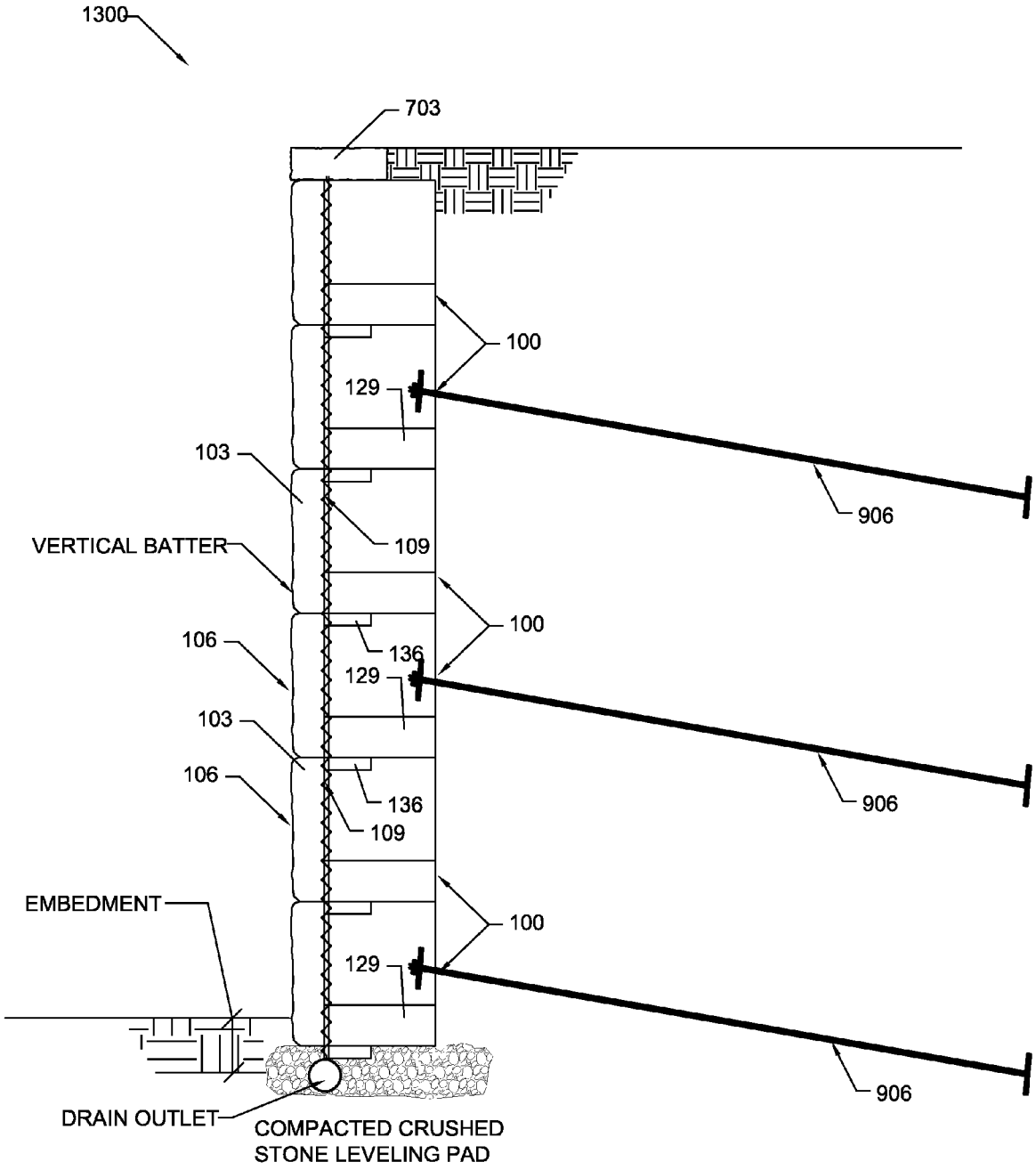
FIG. 13 is a cross-sectional view an exemplary precast wall system including the soil nail connection of FIG. 9 in accordance various embodiments of the disclosure.

FIG. 9 illustrates a soil nail connection that may also be utilized to connect a modular block 100 of a precast wall system to a cut face of earth behind the wall system. In the exemplary embodiment of FIG. 9, an anchor bar 906, such as a threaded bar, extends into the modular block 100 through the vertical slot, and is secured by a fastener, e.g., a nut 916, washer 919, and/or plate 909, to a soil nail bar or earth anchor that has been fixed in the cut face of the earth behind the wall system. In other embodiments, the anchor bar 906 may include other securing means such as, but not limited to, a pin and washer combination or a bolt head. In some embodiments, the anchor bar 906 may include a plurality of sections that are coupled together to provide the desired length. FIG. 13 is a cross-sectional view illustrating a precast wall system 1300 including the anchor bar 906 extending into the earth behind the wall system 1300. As depicted, the anchor bar 906 extends rearward from the vertical slot 146 of the rear panel portion 143.

Referring back to the exemplary precast wall system 700 of FIG. 7, the front of the aligning elements 136 are seated against the rear surface 109 of the front face portion 103 to align the front face 106 of a block 100 in an upper course with the front face 106 of a block 100 in a lower course. In some embodiments, interlocking means such as, but not limited to, a rebar rod may be placed in channels or recesses of adjacent blocks 100 to provide additional horizontal alignment and stability.

In the embodiment of FIG. 7, the precast wall system 700 includes a cap unit 703 placed on the top course of modular blocks 100. In one embodiment, the cap unit 703 includes one or more alignment seats on a bottom surface. In other embodiments, the cap unit 703 may not include alignment seats on the bottom surface.

Figure 10:
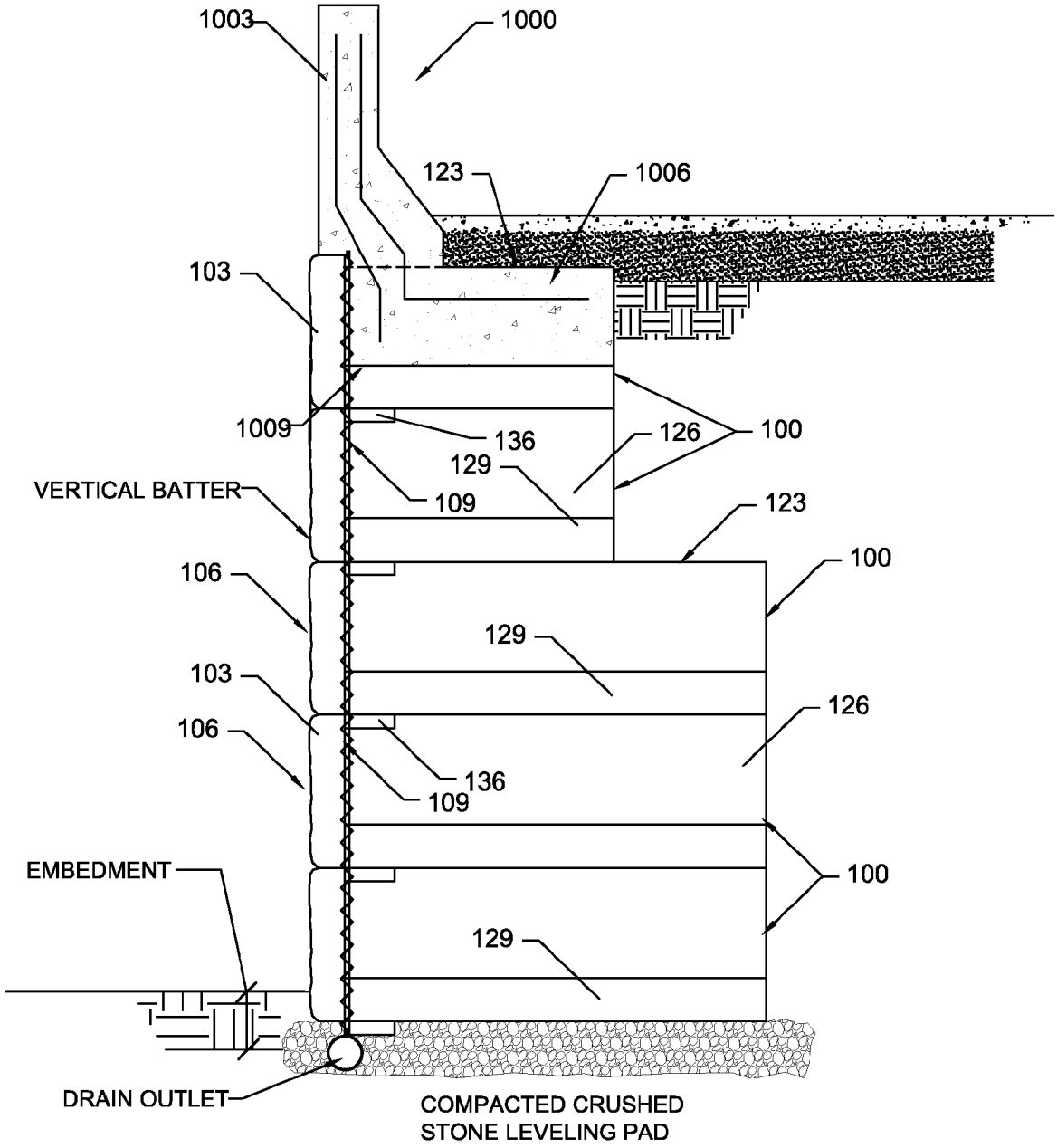
FIG. 10 is a cross-sectional view an exemplary precast wall system including a traffic barrier in accordance various embodiments of the disclosure.

In the embodiment of FIG. 10, one or more modular blocks in the top course of the precast wall system 1000 includes a traffic barrier 1003. In one embodiment, the traffic barrier 1003 is connected to the modular block, e.g., to the web portions 123. Alternatively, the modular block may be fabricated with the traffic barrier 1003 may be integrated into the modular block. For example, the modular block/traffic barrier may be fabricated with reinforcing rods (rebar) 1006 extending through the traffic barrier 1003 into the web portions 123. This allows for the elimination of a typical moment slab for the traffic barrier. The modular block helps to prevent tipping of the traffic barrier 1003 when impacted (e.g., by a moving vehicle).

In the embodiment of FIGS. 1A-1E as well as an additional embodiment as illustrated in FIGS. 15A-15E, the modular retaining wall system transfers the backfill load to the skeletal system of the blocks to act together as a "gravity" system to resist earth and surcharge pressure.

Figure 15A:
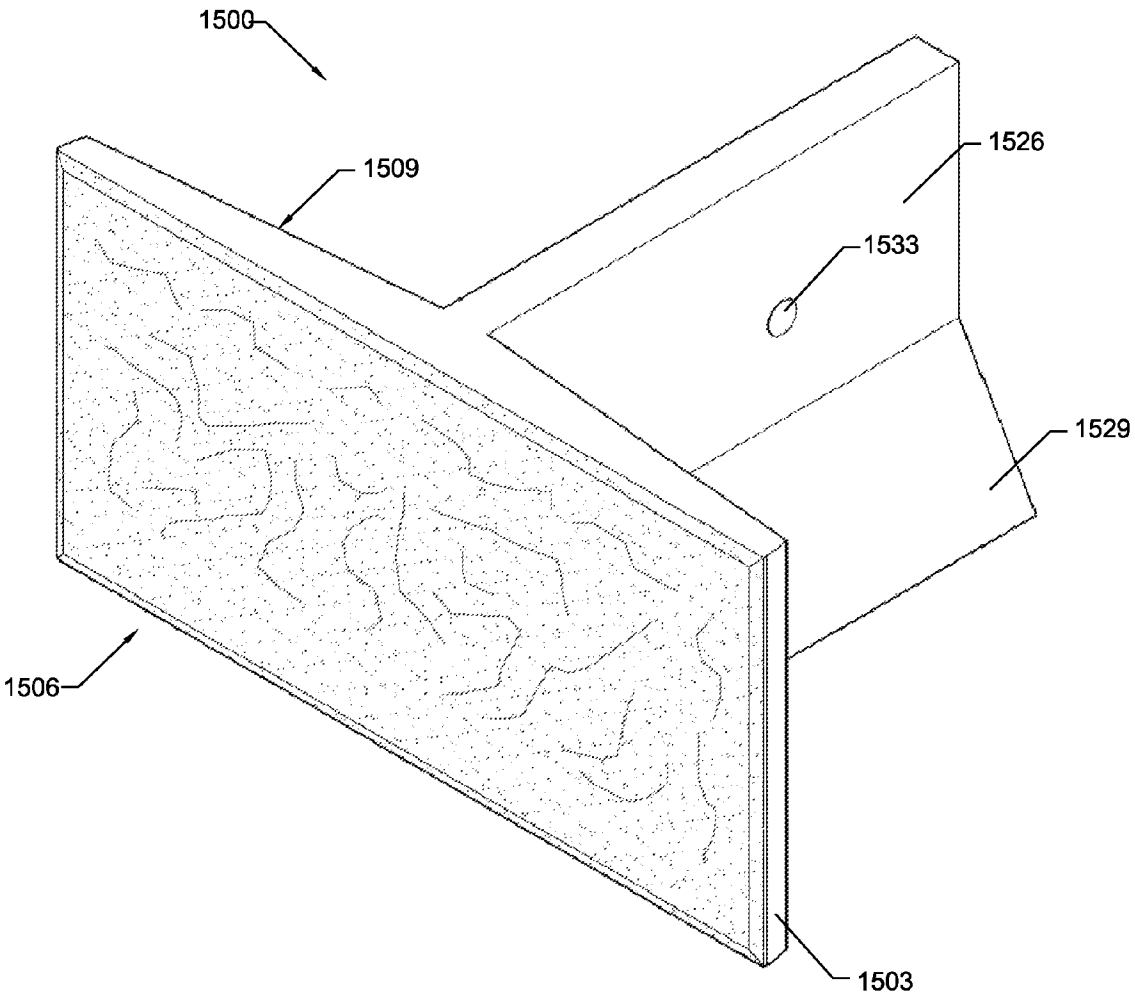
FIG. 15A-15E are views of another exemplary precast wall system modular block in accordance various embodiments of the disclosure.
Figure 15B:
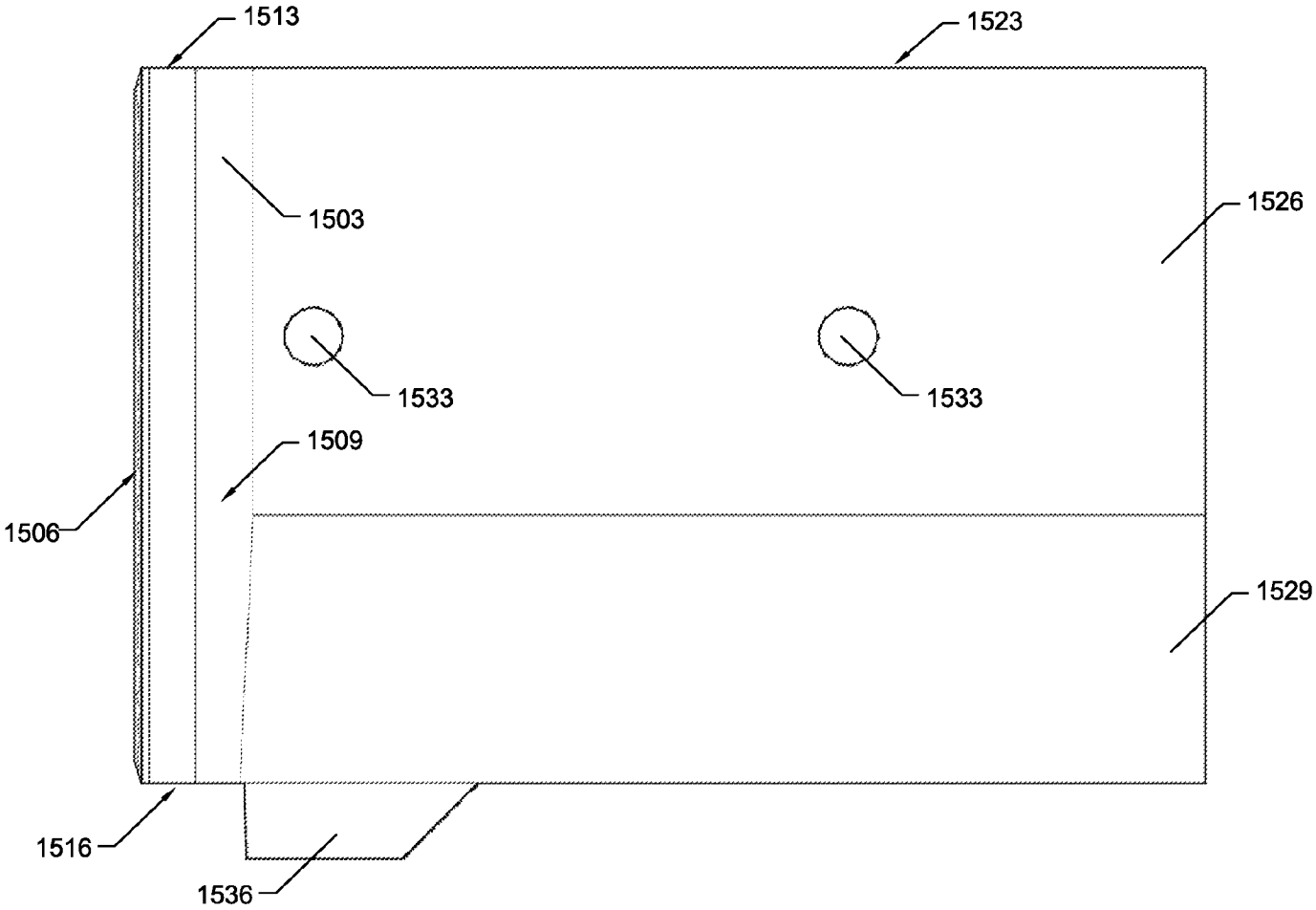
Figure 15C:
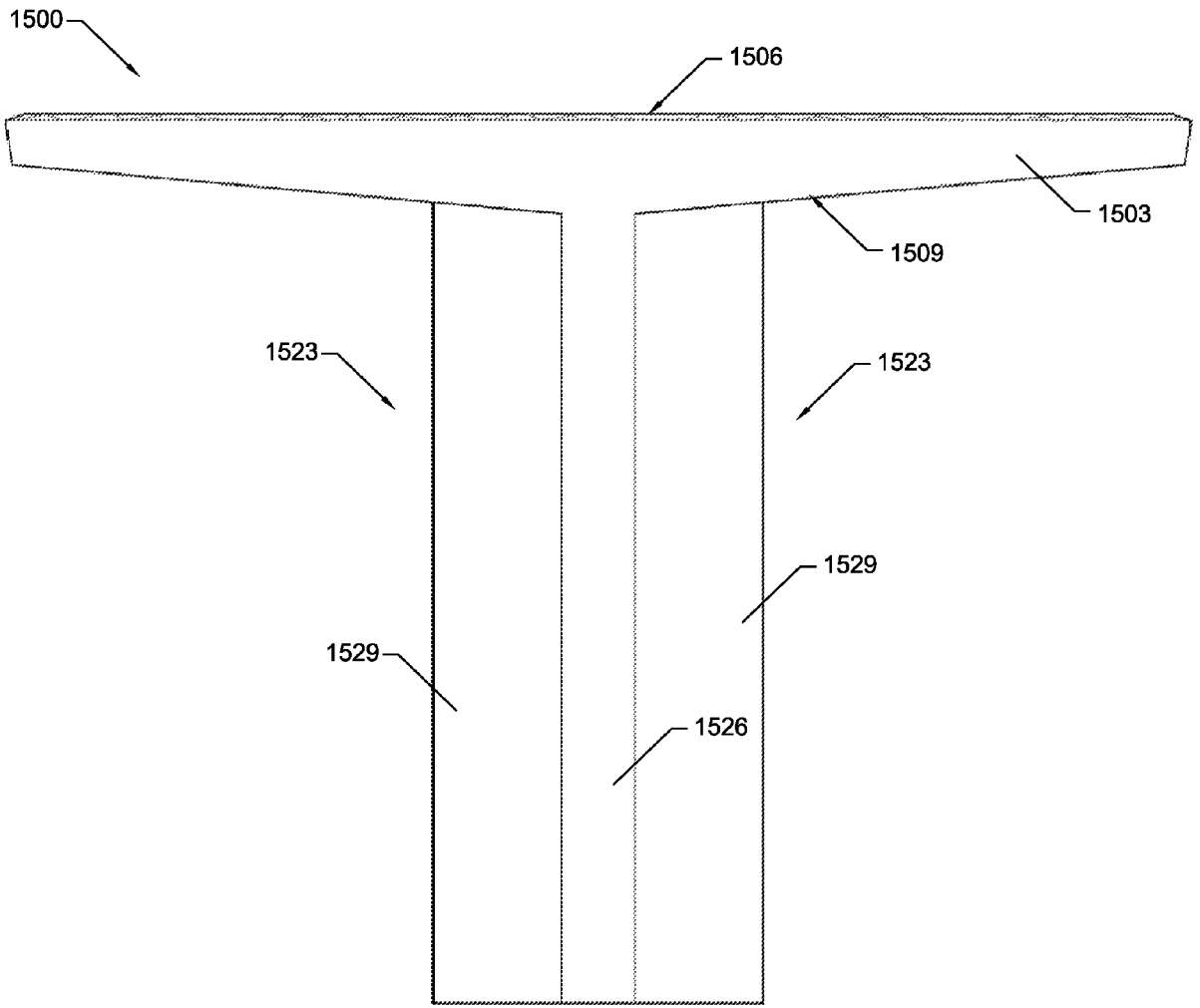
Figure 15D:
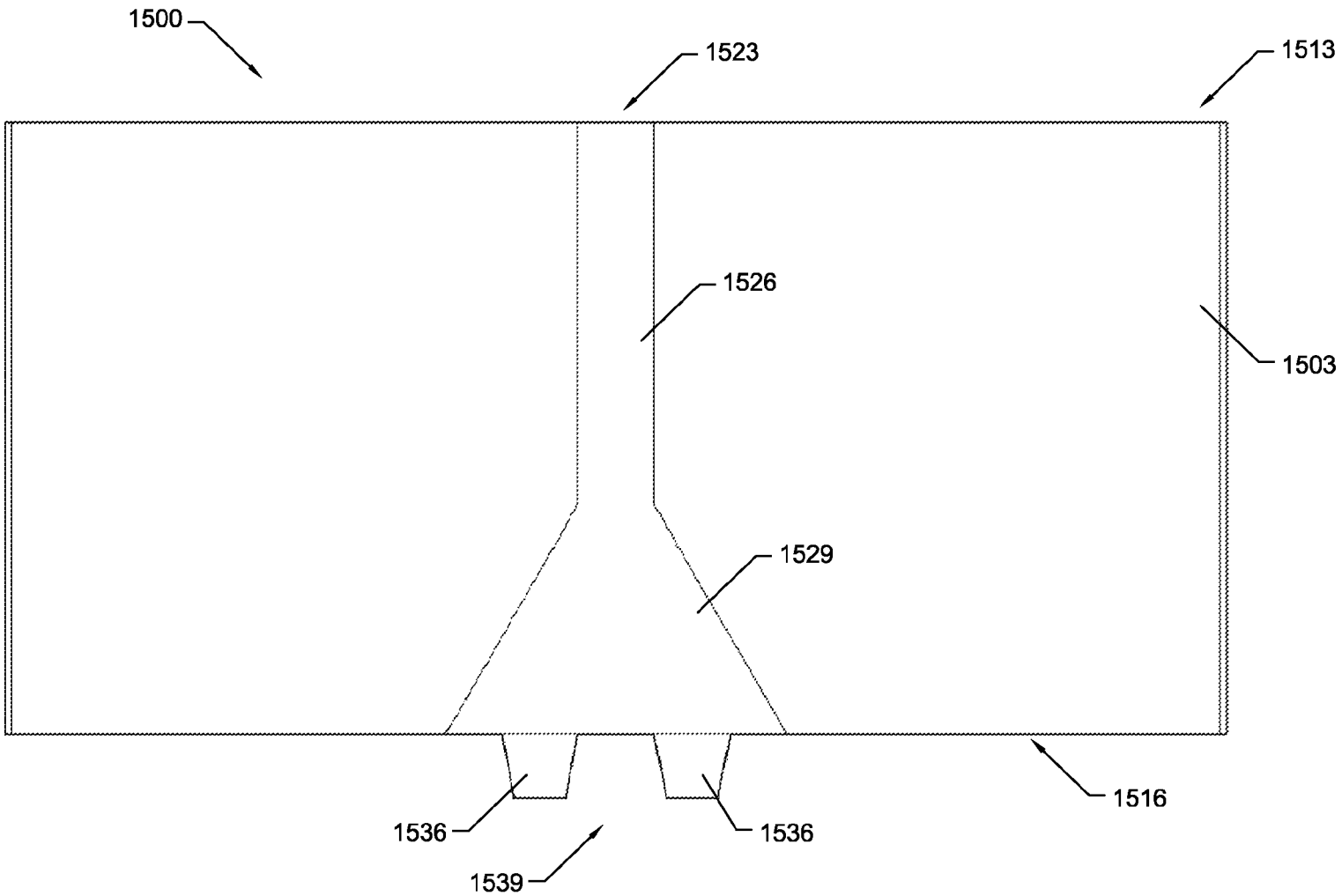
Figure 15E:
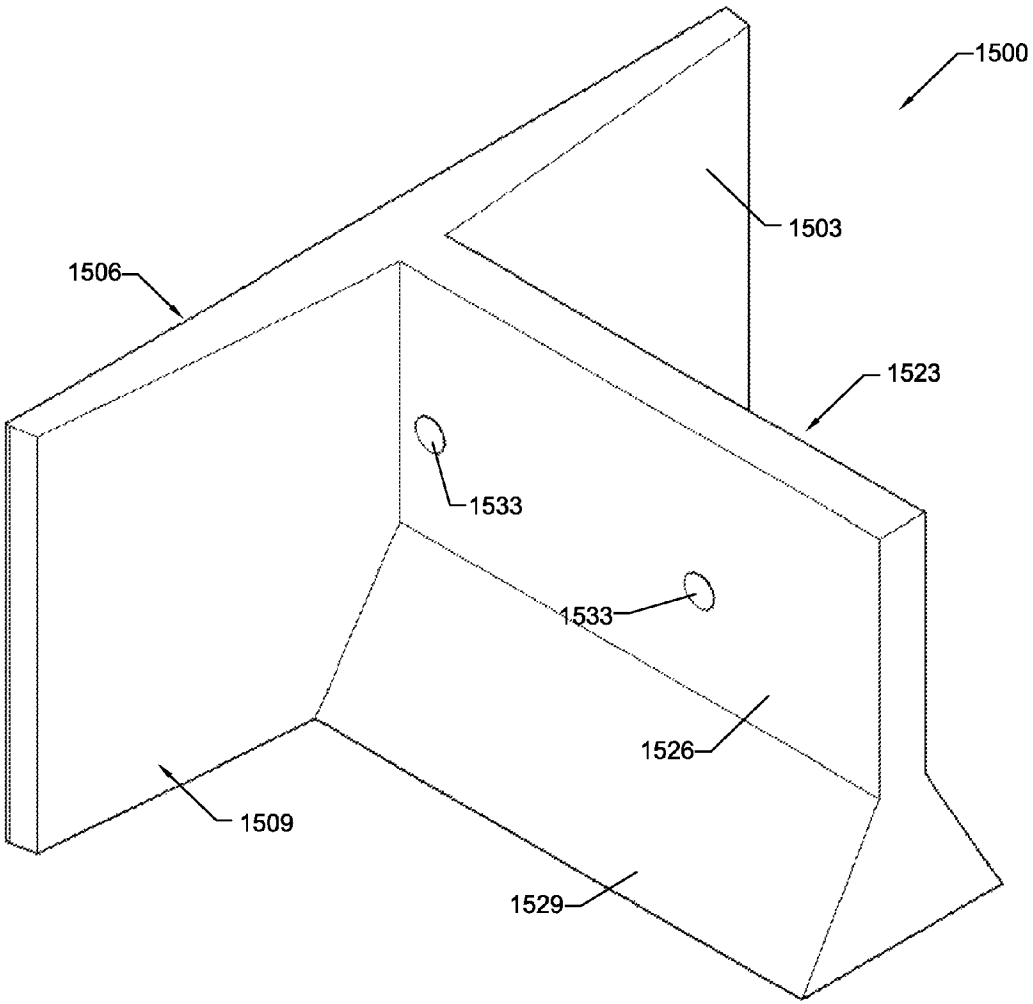

Another embodiment of a precast wall system modular block will now be described with reference to FIGS. 15A-15E. Shown is an exemplary embodiment of a modular block 1500 including a horizontally-oriented, rectangular front face portion 1503 including a front surface 1506, a rear surface 1509, a top surface 1513, and a bottom surface 1516. Other embodiments can include, but are not limited to, vertically oriented rectangular front face portions and/or front face portions of different dimensions. The front face portion 1503 may include a front surface 1506 that is sculptured or textured as illustrated in FIG. 15A. A mold liner is used to produce the desired texture of the front face portion 1506.

In a specific embodiment, among other possible embodiments, the front face portion 1503 of modular block 1500 has a height of about 48 inches, a width of about 96 inches, and a thickness that varies from the outside of 4 inches to the inside of 8 inches.

In another specific embodiment, the front face portion 1503 has a height of about 18 inches, a width of about 36 inches, and a thickness that varies between 2 inches and 5 inches.

Figure 21:
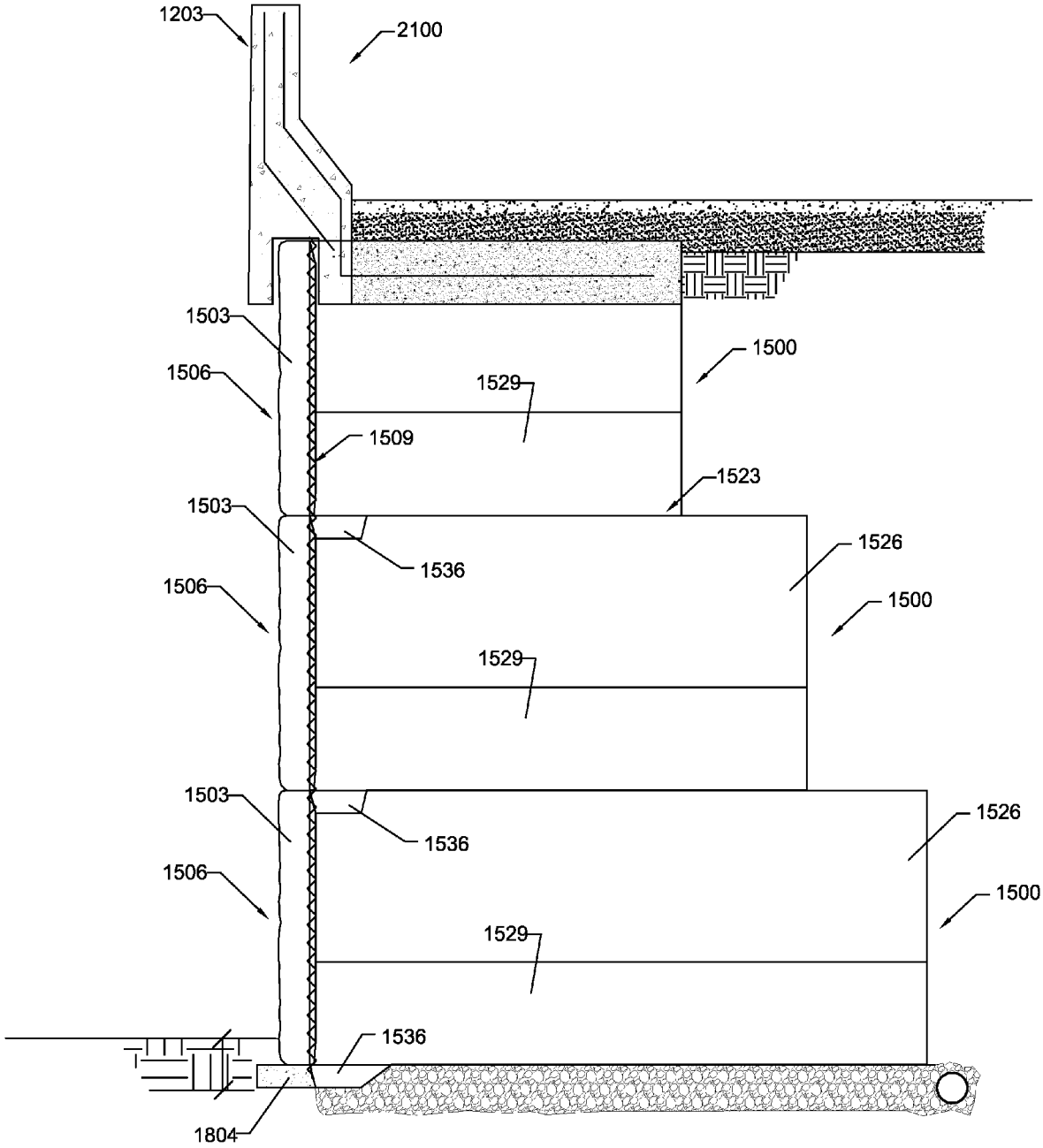
FIG. 21 is a cross sectional view an exemplary precast wall system of FIG. 16 including a traffic barrier in accordance various embodiments of the disclosure.

The modular block 1500 also includes one or more web portions 1523 extending from the rear surface 1509 of the front face portion 1503. In the embodiment of FIGS. 15A-15E, a single web portion 1523 extends from the rear surface 1509 of the front face portion 1503. In one embodiment, the web portion(s) 1523 extends from (or beyond) the rear surface 1509 to a depth of about 64 inches. If the thickness of the front face portion 1503 is about 8 inches, the overall depth of the exemplary modular block 1500 is about 72 inches. In other embodiments (as illustrated in FIG. 21), the extension depth of the web portion 1523 can vary.

The web portion 1523 includes a vertical center portion 1526 that extends from the top surface 1513 to the bottom surface 1516 of the front face portion 1503. Protrusions 1529 extend from the lower sides of the vertical center portion 1526. In the embodiment of FIGS. 15A-15E, the protrusions 1529 are substantially triangular. The substantially triangular protrusions 1529 may extend rearward along at least a portion of the web portion 1523. In the embodiment of FIGS. 15A-15E, the substantially triangular protrusion 1529 along both sides of the outer surface of the web portion 1523 extends the entire length of the web portion 1523. In the embodiment of FIGS. 15A-15E, the vertical center portion 1526 has a thickness of about 5 inches and the substantially triangular protrusions 1529 extend from the sides of the vertical center portion 1526 about 9 inches. Alternatively, the vertical center portion 1526 may have a thickness of about 3 inches and the substantially triangular protrusions 1529 extend from the sides of the vertical center portion 1526 about 6 inches.

Web portion 1523 may also include one or more lifting and/or attachment holes 1533, such as illustrated in the exemplary embodiment of FIGS. 15A-15E. The lifting holes 1533 may be positioned in a centroid position to maintain the modular block in a level orientation when raised and during installation. This location of the lifting holes 1533 also allows for pivoting of the block.

Figure 16:
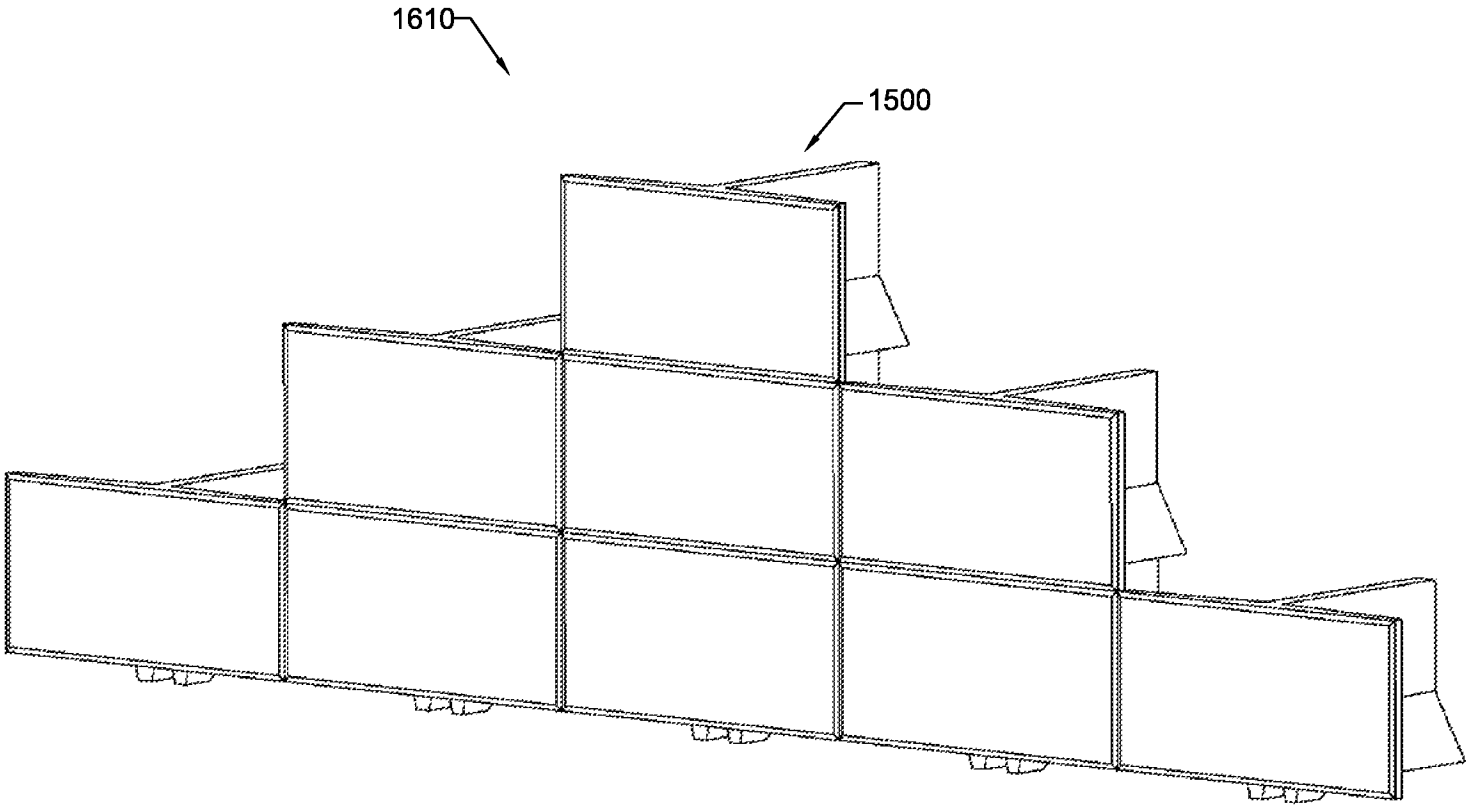
FIG. 16 is a view of an exemplary precast wall system including the precast wall system modular block of FIGS. 15A-15E in accordance various embodiments of the disclosure.
Figure 17:
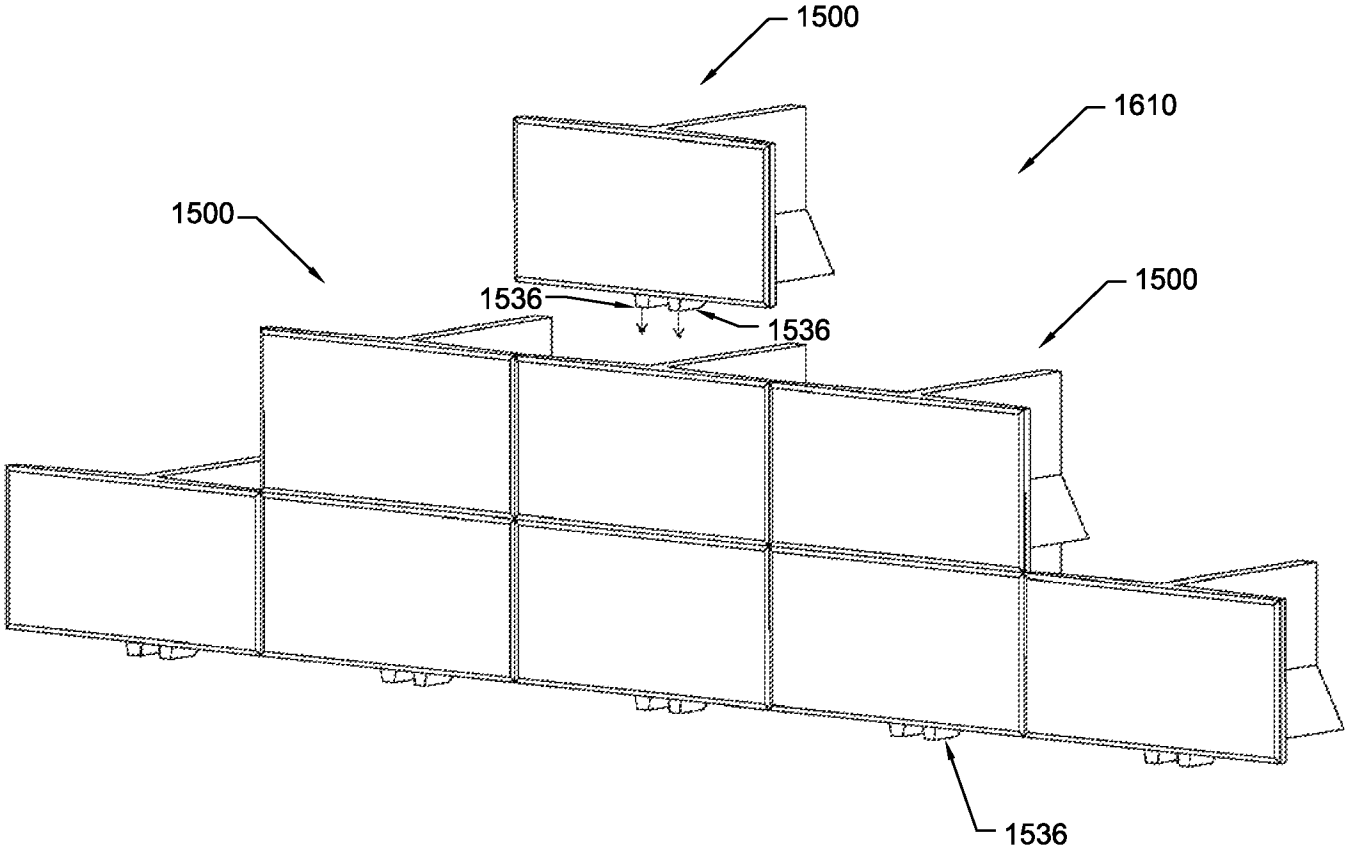
FIG. 17 illustrates the placement of the modular block of FIGS. 15A-15E to an exemplary precast wall system of FIG. 16 in accordance various embodiments of the disclosure.

With reference to FIG. 16, shown is an exemplary precast wall system 1610 in accordance with various embodiments of the disclosure. The precast wall system 1610 includes a plurality of courses of modular blocks 1500. In some embodiments, the precast wall system 1610 may include blocks 1500 of different sizes, shapes, and orientations. Each modular block 1500 may be configured so as to mate with at least one other modular block 1500 when the blocks are stacked atop one another to form the modular retaining wall 1610 as illustrated in FIG. 17. This mating restricts relative movement between vertically adjacent modular blocks 1500 in at least one horizontal direction. To provide for this mating, the modular blocks 1500 can include locking means that secure the blocks 1500 together to further increase wall stability.

Referring back to the exemplary embodiment of FIGS. 15A-15E, the locking means may be provided on web portions 1509 by aligning elements 1536 such as, but not limited to, tabs or nodes that extend from the bottom of the protrusions 1529. The aligning elements 1536 of FIGS. 15A-15E extend along the bottom of the protrusions 1529 from the rear surface 1509 of the front face portion 1503 towards the rear of the web portion 1523 to form an alignment seat 1539. The aligning elements 1536 may extend rearward along a portion of the substantially triangular protrusion 1529 or along the entire length of the substantially triangular protrusion 1529. When stacked atop one or more blocks 1500, the alignment seat 1539 is positioned atop the vertical center portion 1526 of a web portion 1523 of a block in the lower course. The front of the aligning elements 1536 is aligned with the rear surface 1509 of the front face portion 1503 to allow the modular blocks 1500 to be properly located with modular blocks 1500 in the lower course and to provide resistance to shear forces from course to course. An aligning element 1536 extends along each side of the vertical center portion 1526 to align the block 1500 and limit lateral movement of the block 1500. In one embodiment, the aligning elements 1536 are tabs having a height of about 5 inches and a depth of about 10 inches. Alternatively, the height may be about 3 inches. Various tab widths and depths can be provided to allow alignment with the top of a web portion 1523 in the lower course. The modular blocks 1500 in the bottom course may lock behind the leveling pad 1804 (e.g., formed by aligning elements 1536).

FIG. 21 illustrates an exemplary precast wall system 2100 including three courses of blocks 1500. In the embodiment of FIG. 21, the depth of the web portions 1523 is increased for the lower courses for overall structure stability and to resist soil and surcharge loads. The additional depth, when combined with the triangular protrusions 1529, provides added stabilization and support for the wall system. Other groupings may be utilized in other embodiments (e.g., different web depths for each course as in FIG. 21).

Figure 19:
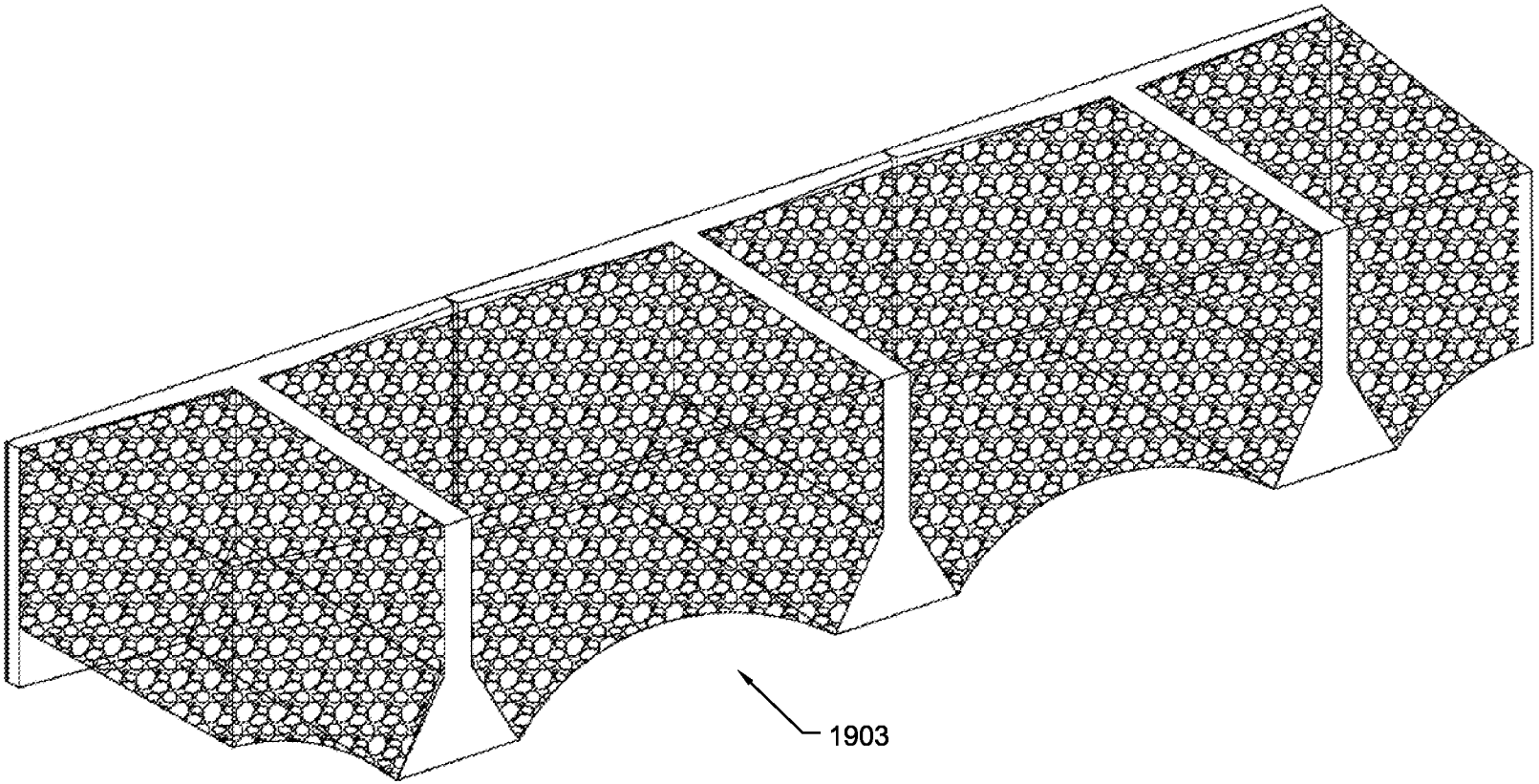
FIG. 19 illustrates the addition of backfill to the modular block of FIGS. 15A-15E to an exemplary precast wall system of FIG. 16 in accordance various embodiments of the disclosure.
Figure 20A:
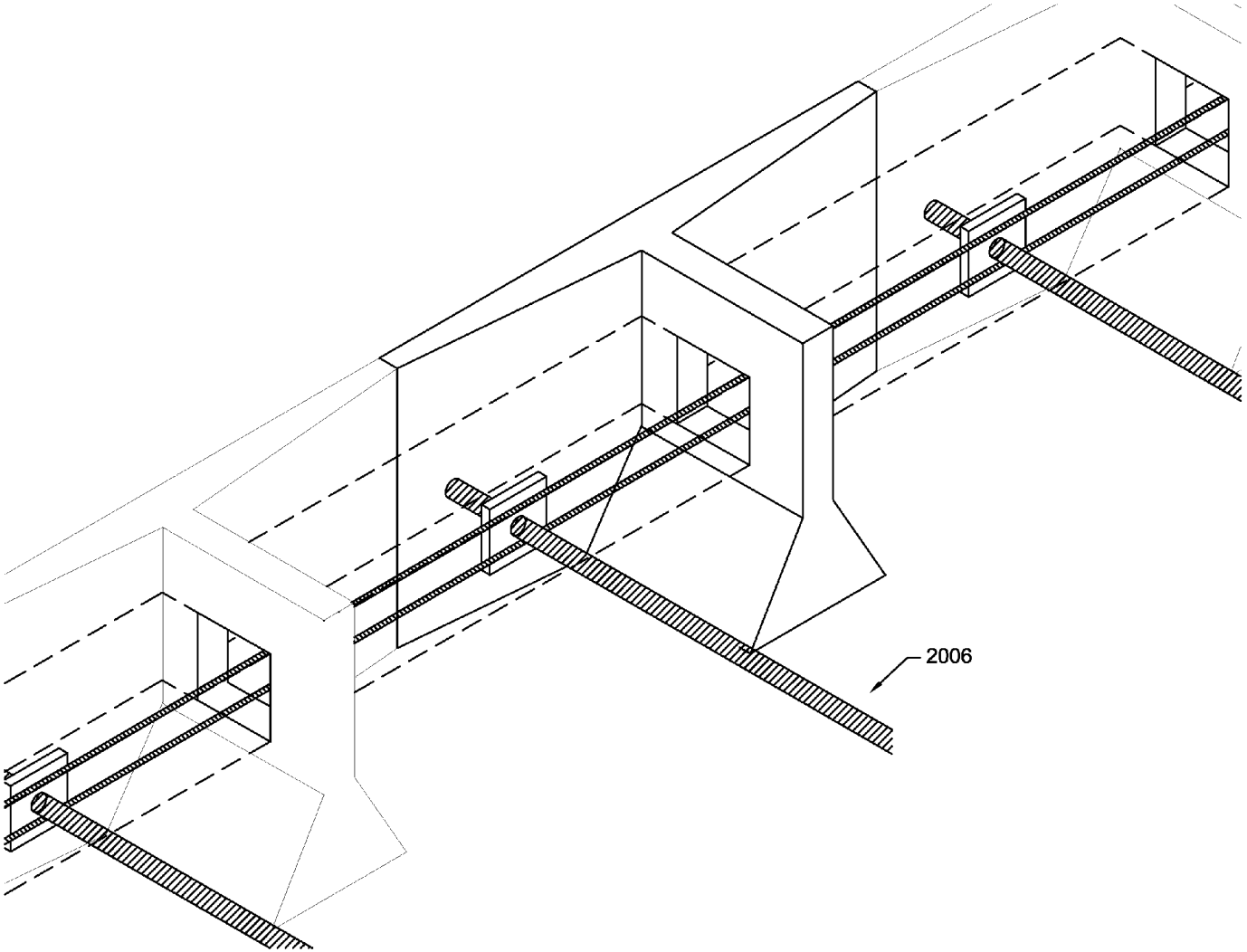
FIG. 20A-20D is a view of the precast wall system modular blocks of FIGS. 15A-15E in an exemplary precast wall system of FIG. 16 including an exemplary earth anchor or soil nail connection in accordance various embodiments of the disclosure.
Figure 20B:
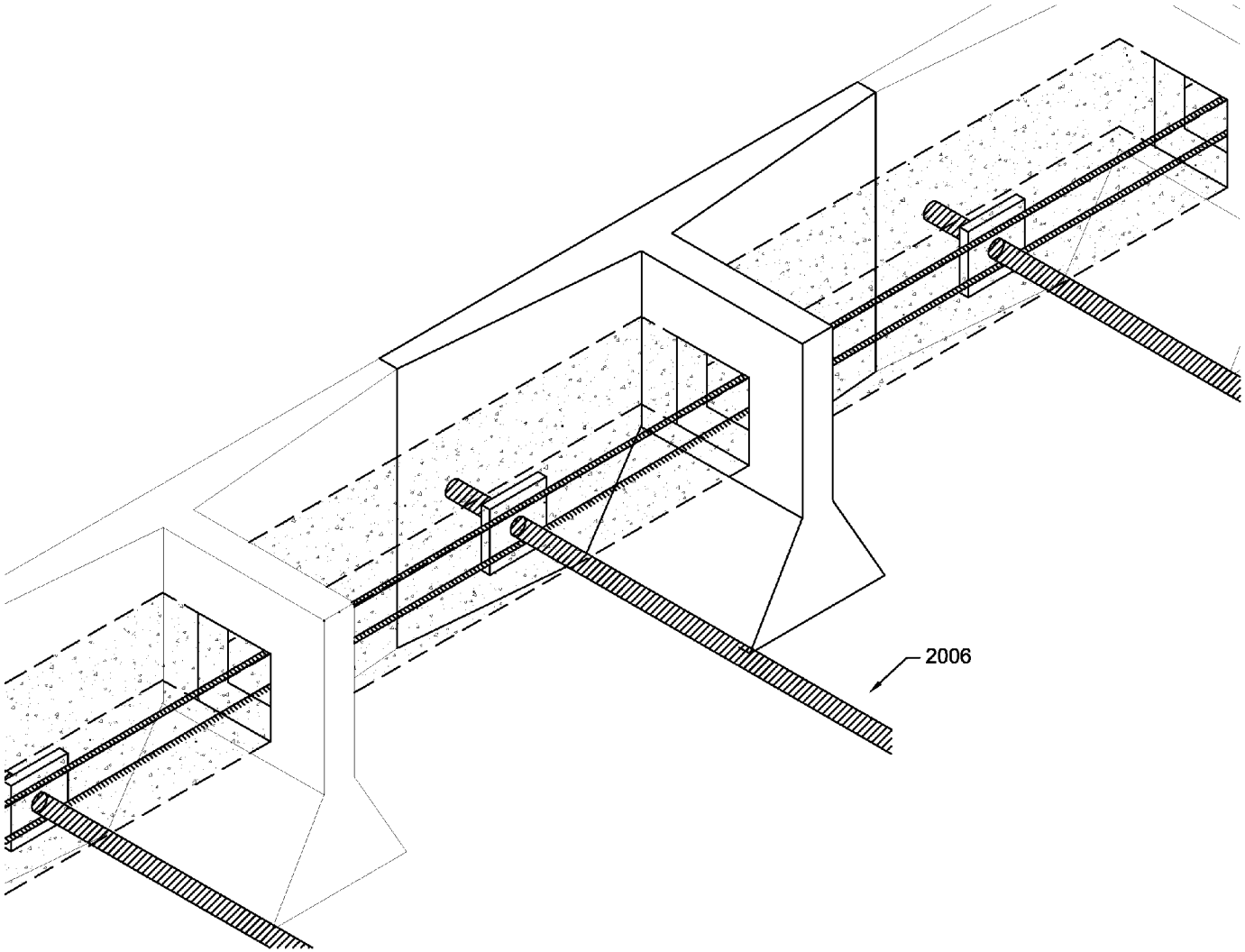
Figure 20C:
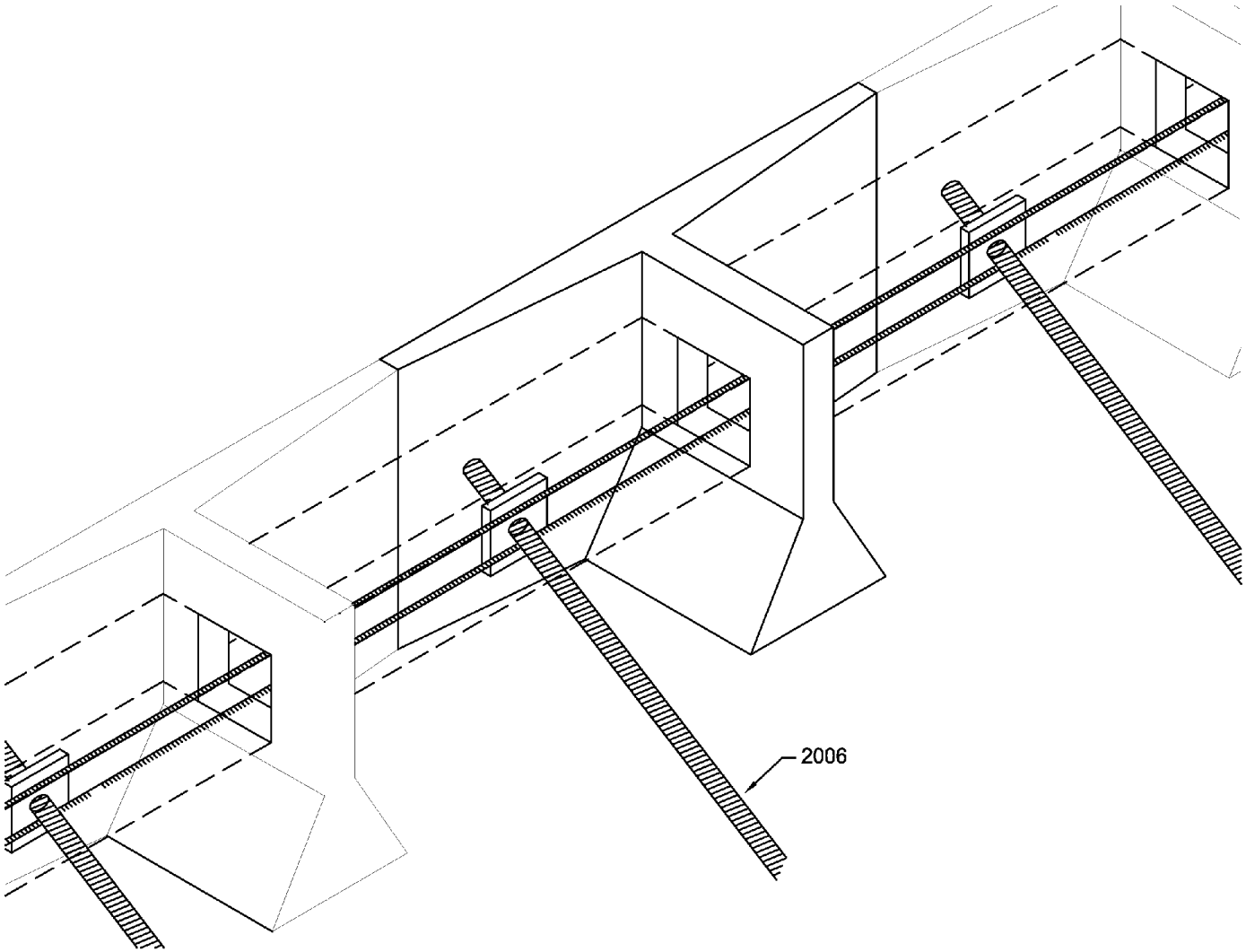
Figure 20D:
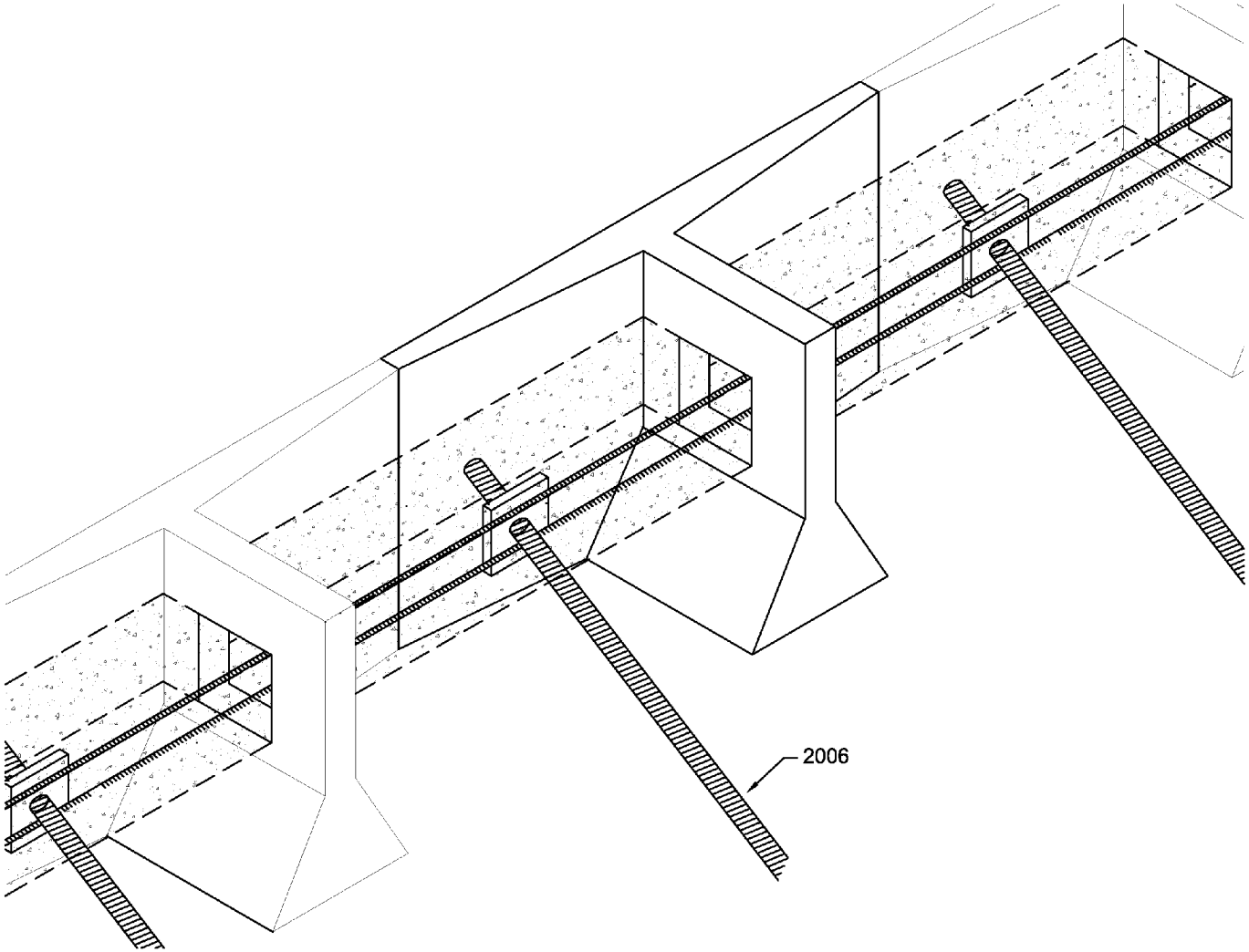

The web portions 1523 of each course extend back into the earth to create a gravity system to resist overturning and sliding of the precast wall system. Stone and/or soil 1903 (as illustrated in FIG. 19) can be deposited on and between the web portions to provide additional downward force on the web portions 1523 of the modular block 1500 to resist overturning or sliding. Referring now to the modular block 1500 of FIG. 19, the substantially triangular protrusions 1529 are obliged at opposing sides of the vertical center portion 1526 to create an arch of the stone and/or soil 1903 placed between the web portions 1523, which creates a downward force on the web portions 1523 of the modular block 1500 to resist movement of the block 1500 from its stationary position, therein creating a stable mass to resist overturning and sliding.

FIGS. 20A-20D illustrate a soil nail or earth anchor connection that may also be utilized to connect a modular block 1500 of a precast wall system 1610 to a cut face of earth behind the wall system 1610. In the exemplary embodiment of FIGS. 20A-20D, an anchor bar 2006, such as a threaded bar, extends between the modular blocks 1500 and is secured by a concrete, poured-in-place reinforced beam, or beamed connection. The reinforced concrete beam is shown in phantom lines in FIGS. 20A-20D. The beam is poured through openings that are defined in the web portion 1523 to provide direct contact to the modular block wall blocks 1500. Preferably, the poured in place concrete encapsulates the nut, washer, and soil nail or earth anchor to provide corrosion protection. The soil nail bar, or earth anchor, has been fixed in the cut face of the earth behind the wall system.

Figure 18:
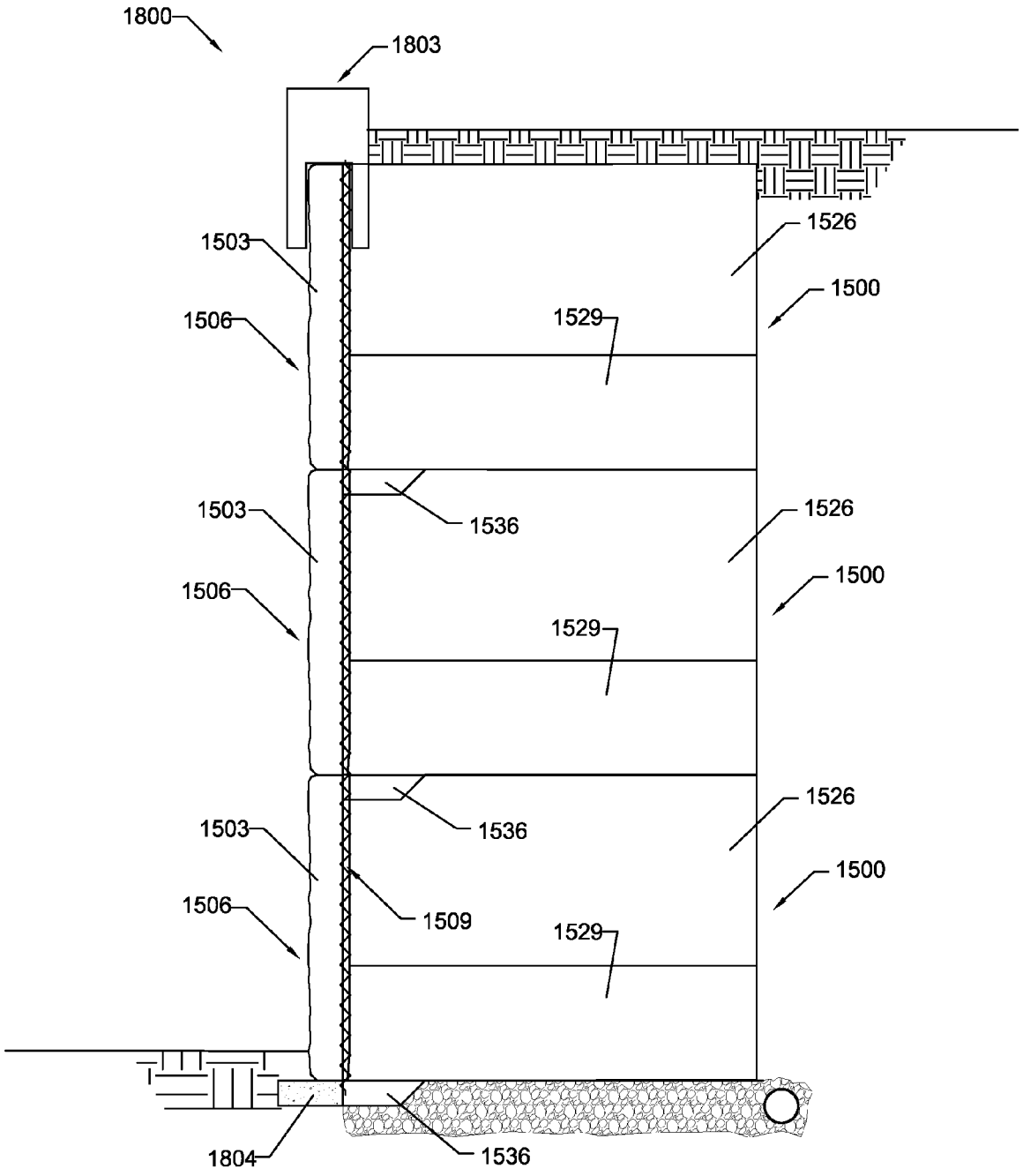
FIG. 18 is a cross sectional view of an exemplary precast wall system of FIG. 16 including a coping unit in accordance various embodiments of the disclosure.

In the embodiment of FIG. 18, the precast wall system 1800 includes a cap unit 1803 placed on the top course of modular blocks 1500.

In the embodiment of FIG. 21, one or more modular blocks 1500 in the top course of the precast wall system 2100 includes a traffic barrier 2103. In one embodiment, the traffic barrier 2103 is connected to the modular block 1500, e.g., to the web portions 1523. The modular block helps to prevent tipping of the traffic barrier 2103 when impacted (e.g., by a moving vehicle).

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, at least the following is claimed:

1. A retaining wall, comprising:

a plurality of stacked rows of precast retaining wall blocks, individual ones of the precast retaining wall blocks comprising a front surface, a top surface, a bottom surface, and an opening defined by internal walls between the top and bottom surfaces;

a geogrid material having a planar elongated body with first and second parts embedded in soil and a third part connecting the first and second parts and extending through the opening of at least one of the precast retaining wall blocks;

wherein the opening extends through a rear panel portion of the at least one of the precast retaining wall blocks, wherein the rear panel portion extends between a web portion extending outwardly from a rear surface of the front surface and an adjacent web portion of the at least one of the precast retaining wall blocks; and wherein the web portion includes a vertical center portion extending from the top surface to the bottom surface of the front surface portion and left and right protrusions extending outwardly from lower sides of the vertical center portion, the left and right protrusions of the at least one of the wall blocks substantially triangular.

2. The retaining wall of claim 1, wherein the opening comprises a vertical slot.

3. The retaining wall of claim 1, wherein the geogrid material extends rearward beyond the rear panel portion of the at least one of the wall blocks.

4. The retaining wall of claim 1, wherein at least a portion of a corner edge of the rear panel portion is curved.

5. The retaining wall of claim 1, wherein at least a portion of a corner edge of the rear panel portion is rounded.

6. The retaining wall of claim 1, wherein at least a portion of a corner edge of the rear panel portion is tapered.

7. The retaining wall of claim 1, further comprising:

a first reinforcing bar extending within the front surface between left and right sides of the front surface; and a second reinforcing bar extending through the opening of the rear panel portion, the second reinforcing bar configured to hook around the first reinforcing bar.

8. A precast retaining wall system comprising:

a first course including a retaining wall block comprising:

a front face portion including a front surface, a rear surface, a top surface, and a bottom surface;

at least one web portion extending outwardly from the rear surface of the front face portion, the at least one web portion including a vertical center portion extending from the top surface to the bottom surface of the front face portion and left and right protrusions extending outwardly from the lower sides of the vertical center portion, the left and right protrusions substantially triangular;

a rear panel portion including an opening defined by a plurality of internal walls between the top surface and the bottom surface extending through the rear panel portion, the rear panel portion extending between the at least one web portion and an adjacent web portion of an adjacent retaining wall block; and a geogrid material extending outwardly from the rear panel through the opening, the geogrid material having a planar elongated body with first and second parts embedded in soil and a third part connecting the first and second parts and extending through the opening of the rear surface; and a second course on top of the first course, the second course including a second retaining wall block comprising:

a front face portion including a front surface, a rear surface, a top surface, and a bottom surface;

at least one web portion extending outwardly from the rear surface of the front face portion, the at least one web portion including a vertical center portion extending from the top surface to the bottom surface of the front face portion and left and right protrusions extending outwardly from the lower sides of the vertical center portion, the left and right protrusions substantially triangular;

a rear panel portion including an opening defined by a plurality of internal walls between the top surface and the bottom surface extending through the rear panel portion, the rear panel portion extending between the at least one web portion and an adjacent web portion of an adjacent retaining wall block;

a geogrid material extending outwardly from the rear panel through the opening, the geogrid material having a planar elongated body with first and second parts embedded in soil and a third part connecting the first and second parts and extending through the opening of the rear surface; and left and right aligning elements extending downwardly from a bottom surface of the left and right protrusions of the second retaining wall block, respectively, a front surface of each aligning element aligned with the rear surface of the front face portion of the respective protrusion, the left and right aligning elements defining an alignment seat engaged with a top portion of the at least one web portion of the first retaining wall block.

9. The precast retaining wall system of claim 8, wherein the at least one web portion and the adjacent web portion of the first retaining wall block extend rearward through the opening and beyond the rear panel portion of the first retaining wall block.

10. The precast retaining wall system of claim 8, further comprising a geogrid material extending through the opening of the first retaining wall block.

11. The precast retaining wall system of claim 8, further comprising a geogrid material extending through the opening of the second retaining wall block.

12. The precast retaining wall system of claim 8, wherein the front surface of at least one of the left and right aligning elements is engaged with the rear surface of the front face portion of the first retaining wall block.

13. The precast retaining wall system of claim 8, wherein the second retaining block further comprises a soil nail connection secured in earth material behind the wall system.

14. The precast retaining wall system of claim 8, wherein the second retaining wall block further comprises a traffic barrier.

15. The precast retaining wall system of claim 8, further comprising a soil nail or earth anchor connecting a beamed connection to each material behind the precast retaining wall system.

16. A precast retaining wall block, configured for assembly into a retaining wall including a plurality of stacked rows of at least a plurality of said retaining wall blocks, said retaining wall block comprising:

a front face portion including a front surface, a rear surface, a top surface, and a bottom surface;

at least one web portion extending outwardly from the rear surface of the front face portion, the at least one web portion including a vertical center portion extending from the top surface to the bottom surface of the front face portion and left and right protrusions extending outwardly from the lower sides of the vertical center portion, the left and right protrusions substantially triangular;

a rear panel portion extending between the at least one web portion and an adjacent web portion of the retaining wall block, wherein the rear panel portion includes an opening extending through the rear panel portion; and a geogrid material having left and right aligning elements extending downwardly from a bottom surface of the left and right protrusions, respectively, a front surface of each aligning element aligned with the rear surface of the front face portion and extending rearward along at least a portion of the respective protrusion, the left and right aligning elements defining an alignment seat configured to engage a top portion of a web portion of a retaining wall block in a lower row of the retaining wall.

17. The precast retaining wall block of claim 15, further comprising a geogrid material extending through the opening of the first retaining wall block.

* * * * *